US006854909B2

(12) United States Patent
Fukumoto et al.

(10) Patent No.: US 6,854,909 B2
(45) Date of Patent: Feb. 15, 2005

(54) LEAD PROPELLING DEVICE

(75) Inventors: Takeo Fukumoto, Yokohama (JP); Kyo Nakayama, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 0 days.

(21) Appl. No.: 10/754,723

(22) Filed: Jan. 12, 2004

(65) Prior Publication Data

US 2004/0141795 A1 Jul. 22, 2004

(30) Foreign Application Priority Data

Jan. 14, 2003 (JP) ..... 2003-005477
Jan. 14, 2003 (JP) ..... 2003-005757

(51) Int. Cl.[7] ..... B43K 21/22

(52) U.S. Cl. ..... 401/92; 401/65; 401/67; 401/93; 401/94

(58) Field of Search ..... 401/53, 55, 57, 401/65–67, 88–90, 92–94

(56) References Cited

U.S. PATENT DOCUMENTS 4,720,203 A * 1/1988 Shimada ..... 401/94
6,203,227 B1 * 3/2001 Noguchi ..... 401/92
6,705,789 B2 * 3/2004 Maruyama et al. ..... 401/93

* cited by examiner

*Primary Examiner*—Tuan Nguyen
(74) *Attorney, Agent, or Firm*—Westerman, Hattori, Daniels & Adrian, LLP

(57) ABSTRACT

The lead propelling device of the invention is a lead propelling device having a structure for gripping and releasing the lead by a lead gripping mechanism by knocking operation, not transmitting the knocking force to the lead gripping mechanism in knock forward operation, wherein a stopper not allowing the lead to pass by its own weight interlocks with the knock operation, the lead abuts against the stopper rear end upon release of the lead, the lead is inserted into the stopper after gripping the lead in knock backward operation, thereby propelling the lead, and therefore after the knock operation part advances by a predetermined distance, the lead gripping mechanism clears gripping of the lead, and when the lead gripping mechanism grips the lead in the backward stroke of the knock operation part, the knock operation part is set to be movable backward further by a predetermined distance.

20 Claims, 40 Drawing Sheets

"PRIOR ART"

FIG. 37 "PRIOR ART"

"PRIOR ART"

"PRIOR ART"

FIG. 40 "PRIOR ART"
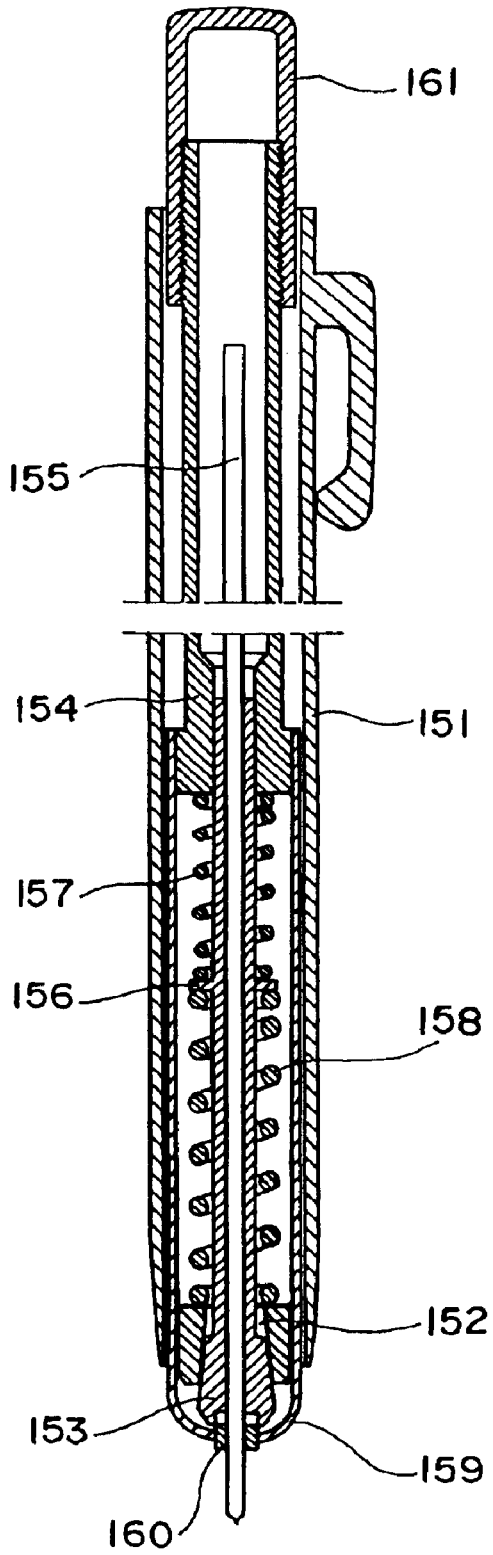

LEAD PROPELLING DEVICE

BACKGROUND OF THE INVENTION

1. Field of the Invention

The present invention relates to a lead propelling device capable of projecting a lead by a predetermined length from the leading end of the writing tool by knocking operation, and maintaining the projected lead by the predetermined length if knocking operation is repeated, and more particularly to an improvement of lead propelling device used in mechanical pencil, writing lead holder, or the like.

2. Description of the Related Art

A structure of a hitherto well-known mechanical pencil is shown in FIG. 36, and it is explained according to the drawing.

As shown in FIG. 36, a chuck 125 is provided at a front portion of a shaft tube 123 by way of a shaft joint 124, and a tightening tool 126 is fitted on the outer periphery of gripping part of this chuck 125. A biased chuck spring 128 is provided between a lead case 127 affixed to the rear end of the chuck 125 and the shaft joint 124. By this chuck spring 128, the chuck 125 is tightened by the tightening tool 126, and a lead 129 is gripped.

A slider 131 is fixed at the leading end of a tip 130 attached at the leading end of the shaft tube 123. The slider 131 has a leading end pipe 132 fixed at a front portion of a shaft 131a, and a holding chuck 133 made of rubber or other elastic material fixed at a rear portion, and the lead 129 projects from the leading end pipe 132 by penetrating through the holding chuck 133.

In this state, when the chuck 125 is advanced by pressing (knocking) a knock cover (not shown) fitted to the upper end of the lead case, since the chuck 125 is tightened by the tightening tool 126, it advances while gripping the lead 129.

As a result, the front end of the tightening tool 126 abuts against a step 130*a* of the tip 130, and when the chuck 125 further advances, tightening by the tightening tool 126 is cleared. Furthermore, if the chuck 125 advances, since the tightening tool 126 is engaged by the step 130*a*, only the chuck 125 moves forward, and the gripping part at the leading end of the chuck 125 is expanded.

When cleared from the knocked state, while the lead 129 is held in the holding chuck 133 and the gripping part of the chuck 125 is expanded, the chuck 125 retreats. The tightening tool 126 abuts against the shaft joint 124, and when the retreat of the tightening tool 126 is blocked, the chuck 125 begins to grip the lead 129.

At the end of knocking (initial state), the chuck 125 completes gripping of the lead 129.

Thus, in the conventional mechanical pencil, every time the knocking operation is repeated, the front end of the gripping tool 126 abuts against the step 130*a* to set in a state of expanding the gripping part of the chuck 125, and the front end of the tightening tool 126 abuts against the shaft joint 124 to set in a state of gripping the gripping part of the chuck 125, and that repeating these states, the lead 129 is propelled sequentially.

In such conventional mechanical pencil, since the lead is spent as writing continues, the lead is propelled by knocking occasionally. If forgetting to knock, the lead is worn up to the front end of the leading end pipe 132, and writing may be scratchy, or finally the writing paper may be torn by the front end of the rigid leading end pipe.

On the other hand, if knocked more than necessary to propel the lead, the projected lead may be too long, and the lead is often broken. Or the lead may be projected more than necessary by knocking unknowingly while writing.

As means for solving such problems, Japanese Utility Model Application Laid-open No. S55-99887 discloses a writing lead holder capable of projecting the lead by a specific length from the leading end of the writing tool by knocking operation and maintaining a specific length of a projected lead if the knocking operation is repeated.

This writing lead holder is explained with reference to FIGS. 37 to 40.

As shown in the figures, at the leading end of the shaft tube 151, a taper hole 152 is formed for fitting the chuck 153 for gripping the lead. Inside of the shaft tube 151, there is a tubular lead case 154 for accommodating a lead 155.

An annular protrusion 156 is formed nearly in an intermediate position of the chuck 153. A coil spring 157 is loaded between the annular protrusion 156 and the lead case 154, and the upper end of the chuck 153 is slidably attached in a hole 154*a* provided in the lower part of the lead case 154. A coil spring 158 is loaded between the annular protrusion 156 and the upper surface of the shaft tube 151 (taper hole 152). The coil spring 158 has a stronger spring than the coil spring 157.

A support arm 159 is affixed to the periphery of the lower part of the lead case 154. A stopper 160 fitting to the leading end of the chuck 153 is formed at the leading end of the support arm 159.

Explaining the operation of the writing lead holder having such structure, first, by removing the cap 161, the writing lead 155 is put into the lead case 154 and chuck 153, and the cap 161 is put on (see FIG. 37). Then, by knocking the cap 161, the lead case 154 compresses the coil spring 157, and moves downward. Along with this move, the support arm 159 also moves downward, and the stopper 160 is departed from the chuck 153 (see FIG. 38). At this time, the upper end of the chuck 153 slides in the hole 154*a* of the lead case 154.

By further knocking the cap 161, the lead case 154 compresses the coil spring 158, and moves downward. Along with this move, the leading end (gripping part) of the chuck 153 is expanded, and the lead 155 falls by its own weight to the stopper 160 (see FIG. 39).

Later, when knocking of the cap 161 is cleared (released), the chuck 153 and support arm 159 restore the initial state by the repulsive force of the coil springs 157, 158. At this time, the chuck 153 is closed by fitting of the taper hole 152, and the lead 155 is gripped. Since the lead 155 is held by the chuck 153, the lead 155 is projected from the stopper 160 by a predetermined length (see FIG. 40).

When the cap 161 is knocked again, since the lead 155 is held by the chuck 153, only the support arm moves downward, and the state becomes as shown in FIG. 39, and when released from knocking, the state becomes as shown in FIG. 40.

Thus, in this proposed writing lead holder, by knocking operation, the lead can be projected from the leading end of the writing tool by a predetermined length, and the projected lead can be maintained at a predetermined length if knocking operation is repeated.

However, since the coil spring 157 biasing the stopper 160 backward and the coil spring 158 biasing the chuck 153 backward are arranged in series across the annular protrusion 156 of the chuck 153, the projecting length of the lead 155 may not be stable.

For example, if the compression of the coil spring 157 biasing the stopper 160 is advanced to increase the biasing force until becoming equal to the initial biasing force of the spring 158 biasing the chuck 153, the chuck 153 begins to move, and expansion of the chuck 153 starts.

That is, by sliding resistance between members or other factor, the expanding timing of the chuck 153 may be delayed, and the lead projecting extent may not be stable.

Besides, the coil spring 157 biasing the stopper 160 continues to be compressed even after start of expansion of the chuck 153, and the stopper 160 continues to advance. As a result, the distance between the stopper 160 for determining the projection of the lead 155 and the leading end of the chuck 153 continues to increase, and the lead projecting amount may not be stable.

In this action, the relation of the biasing force of the coil springs is expressed as $x1<y1$, $x2=y1$, where x1 is the initial biasing force of the coil spring 157 biasing the stopper 160 backward, x2 is the biasing force when the chuck 153 begins to expand, and y1 is the initial biasing force of the coil spring 158 biasing the chuck 153 backward.

The coil spring 158 for biasing the chuck 153 backward is regulated by the rule as mentioned above in relation to the biasing force of the coil spring 157 for biasing the stopper 160 backward (the coil spring 158 is required to have a stronger biasing force), and, for example, if the lead is very fine in a mechanical pencil, the lead may be broken or damaged by the chuck, and it may be bit (broken) and the surface may be roughened (damaged).

In other action, in the case the chuck 153 begins to be expanded when the coil spring 157 biasing the stopper 160 is fully compressed, the overall length of the coil spring 157 when compressed fully may be changed easily due to fluctuations of wire rod diameter, fluctuations of number of turns, or deviation in the radial direction when winding the coil tightly.

In this action, the relation of the biasing force of the coil springs is expressed as $X1<Y1$ and $X2<Y1$, where X1 is the initial biasing force of the coil spring 157 biasing the stopper 160 backward, X2 is the biasing force when compressed fully, and Y1 is the initial biasing force of the coil spring 158 biasing the chuck 153 backward.

In this action, too, the coil spring 158 for biasing the chuck 153 backward is regulated by the rule as mentioned above in relation to the biasing force of the coil spring 157 for biasing the stopper 160 backward (the coil spring 158 is required to have a stronger biasing force), and, for example, if the lead is very fine as mentioned above, the lead 155 may be bit by the chuck 153, and the surface may be roughened.

In this writing lead holder, members very difficult to machine are used, which is also a bottleneck for realizing this proposal.

For example, as for the shaft tube 151, aside from forming a taper hole 152 at the leading end, through-holes 151*a* (see FIG. 38) for pass-through of the support arm 159 of the stopper 160 must be formed at two positions, and this shape is very difficult to process, the productivity is poor, and it is predicted to be a very expensive component.

The support arm 159 requires a very long distance up to the leading end of the lead case 154, and since it is passed in the shaft tube 151, it is predicted that the thickness and width may not be assured sufficiently. The stopper 160 is formed integrally in the support arm 159 but such support arm is very difficult to process, the productivity is poor, and it is predicted to be a very expensive component.

It is also difficult to assemble the writing lead holder. For example, the coil spring 158 biasing the chuck 153 backward is placed between the annular protrusion 156 provided in the center of the chuck 153 and the leading end inner side of the shaft tube 151, but it is impossible to assemble as far as estimated.

Aside from such inconvenience, this proposal seems to project a thick lead as the name of writing lead holder suggests, and this structure is not suited to a mechanical pencil using a fine lead. In a mechanical pencil, for example, since the lead is fine, and in order to prevent lead from breakage, the leading end for projecting the lead and the chuck must be disposed so as not to cause misalignment while maintaining enough rigidity To prevent lead breakage, the projecting length of lead is set to be short, and the leading end of the writing tool must be thinly tapered so that the leading end may be easily visible while writing.

SUMMARY OF THE INVENTION

The invention is devised to solve the problems of lead breakage and excessive propelling of the lead by knocking unknowingly while writing, and it is hence an object thereof to present a lead propelling device capable of projecting a lead by a predetermined length from the leading end of the writing tool by knocking operation, and maintaining the projected lead by the predetermined length if knocking operation is repeated, and more particularly a lead propelling device stable in lead projecting length, easy to recognize the leading end, easy to use, and free from risk of biting by the gripping part of the chuck even in the case of a fine lead.

The lead propelling device of the invention devised to achieve such object is a lead propelling device having a structure for gripping and releasing the lead by a lead gripping mechanism by knocking operation, not transmitting the knocking force to the lead gripping mechanism in knock forward operation, in which a stopper not allowing the lead to pass by the own weight of the lead interlocks with the knock operation, the lead abuts against the stopper rear end when the lead gripping mechanism releases the lead, the lead is inserted into the stopper after the lead gripping mechanism grips the lead in knock backward operation, thereby propelling the lead, and therefore after the knock operation part advances by a predetermined distance, the lead gripping mechanism clears gripping of the lead, and when the lead gripping mechanism grips the lead in the backward stroke of the knock operation part, the knock operation part is set to be movable backward further by a predetermined distance.

In this manner, in the lead propelling device of the invention, since the timing of gripping and releasing the lead by the lead gripping mechanism is defined by the distance to the parts interlocking with the knock operation, the lead can be projected by a predetermined length, and the projecting length can be stabilized.

The lead propelling device of the invention devised to achieve such object according to another aspect is a lead propelling device for releasing the lead by a lead gripping mechanism by knock operation and gripping the lead by the lead gripping mechanism when the knock operation is cleared, in which a slider is provided so as to project movably forward and backward from the leading end hole at the tip of the leading end of a shaft tube, an elastically dislocating stopper is fixed in the inner hole of the slider for allowing the lead to pass and blocking pass-through of the lead by abutting against the leading end of the lead at equal to or below a predetermined pressing force, the slider is biased backward by a spring so as to interlock with a lead case, a lead gripping mechanism is provided behind the slider, the lead gripping mechanism is composed so as to grip or release the lead by departing or abutting between a step of the rear part of the lead gripping mechanism and a step of the lead case, the lead gripping mechanism holds the lead until the knock operation part advances by a predetermined distance, maintaining a fixed state, the slider advances in conjunction with the lead case, and the front end of the lead is departed from the rear end of the stopper by a predetermined distance, and when the knock operation part is further advanced from the predetermined distance, the slider and chuck advance in conjunction with the lead case, and the lead gripping mechanism releases gripping of the lead, the lead abuts against the stopper rear end by spontaneous fall of the lead, when the knock operation part moves backward by clearing the knock operation, the slider and chuck retreat, and when the lead gripping mechanism grips the lead, only the slider moves backward to the initial position and the lead passes through the stopper, so that the lead is projected from the leading end of the slider by a predetermined length.

Thus, the lead propelling device of the invention has a structure for gripping and releasing the lead by the lead gripping mechanism for allowing departing and abutting between the step of the lead gripping mechanism rear part and the step of the lead case, and the timing of gripping and releasing the lead by the lead gripping mechanism is determined by the spatial distance of the action part of the lead gripping mechanism rear part and the action part of the lead case.

Therefore, the lead projecting length is stable. If the lead is fine, rigidity is maintained between the slider for projecting the lead and the lead gripping mechanism, and misalignment is prevented. Besides, in order that the leading end may be easily recognized visually while writing, the leading end of the writing tool is tapered and thin.

According to an another aspect, the lead propelling device of the invention devised to achieve such object is a lead propelling device for releasing the lead by a lead gripping mechanism by knock operation and gripping the lead by the lead gripping mechanism when the knock operation is canceled, in which a slider is provided so as to project movably forward and backward from the leading end hole at the tip of the leading end of a shaft tube, an elastically dislocating stopper is fixed in the inner hole of the slider for allowing the lead to pass and blocking pass-through of the lead by abutting against the leading end of the lead at equal to or below a predetermined pressing force, the slider is biased backward by a spring so as to interlock with a lead case by way of a link unit, a lead gripping mechanism is provided at a rear portion of the slider in a state of gripping the lead, the lead gripping mechanism maintains the lead gripping state when knock operation is started, the slider advances in conjunction with the lead case by way of the link unit, the lead is departed from the stopper rear end by a predetermined distance when the slider advances to the maximum and the advance is blocked, and when the knock operation further continues, the link unit contracts and the lead case advances, thereby releasing the lead by the lead gripping mechanism, the lead abuts against the stopper rear end by spontaneous fall of the lead, when knock operation is canceled, the lead gripping mechanism grips the lead while the slider maintains the foremost position, and the slider retreats to the initial position, and the lead passes through the stopper, so that the lead is projected from the leading end of the slider by a predetermined length.

Even if this lead propelling device, the lead can be projected by a predetermined length, and the projection length can be stable.

BRIEF DESCRIPTION OF THE DRAWINGS

FIG. 40 is a sectional view showing working state of writing lead holder shown in FIG. 37.

DESCRIPTION OF THE PREFERRED EMBODIMENTS

Embodiments are described below with reference to the accompanying drawings. FIGS. 1 to 16 show a lead propelling device in a first embodiment of the invention.

Figure 1:
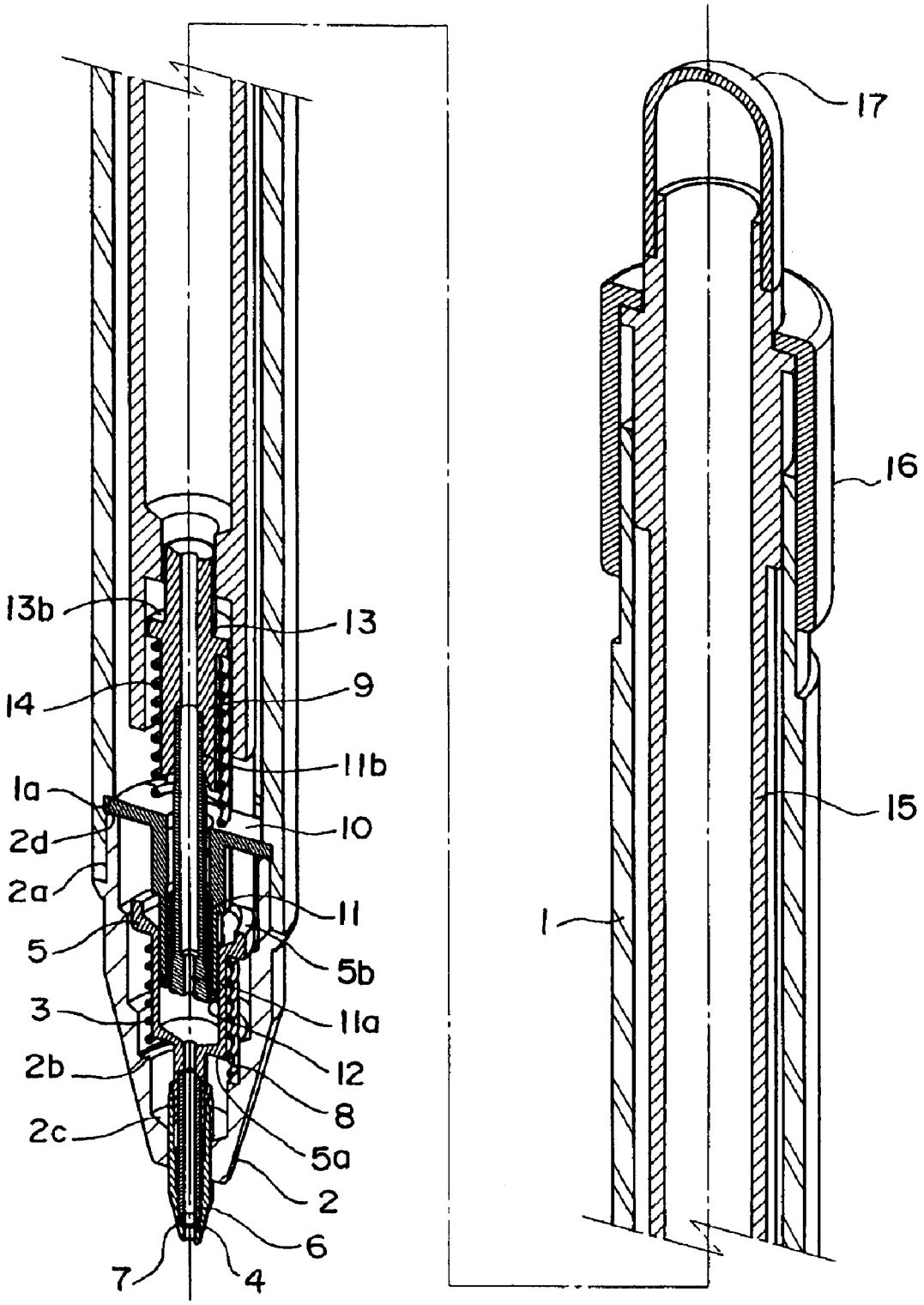
FIG. 1 is a general longitudinal sectional view of initial state of mechanical pencil in a first embodiment of the invention.
Figure 2:
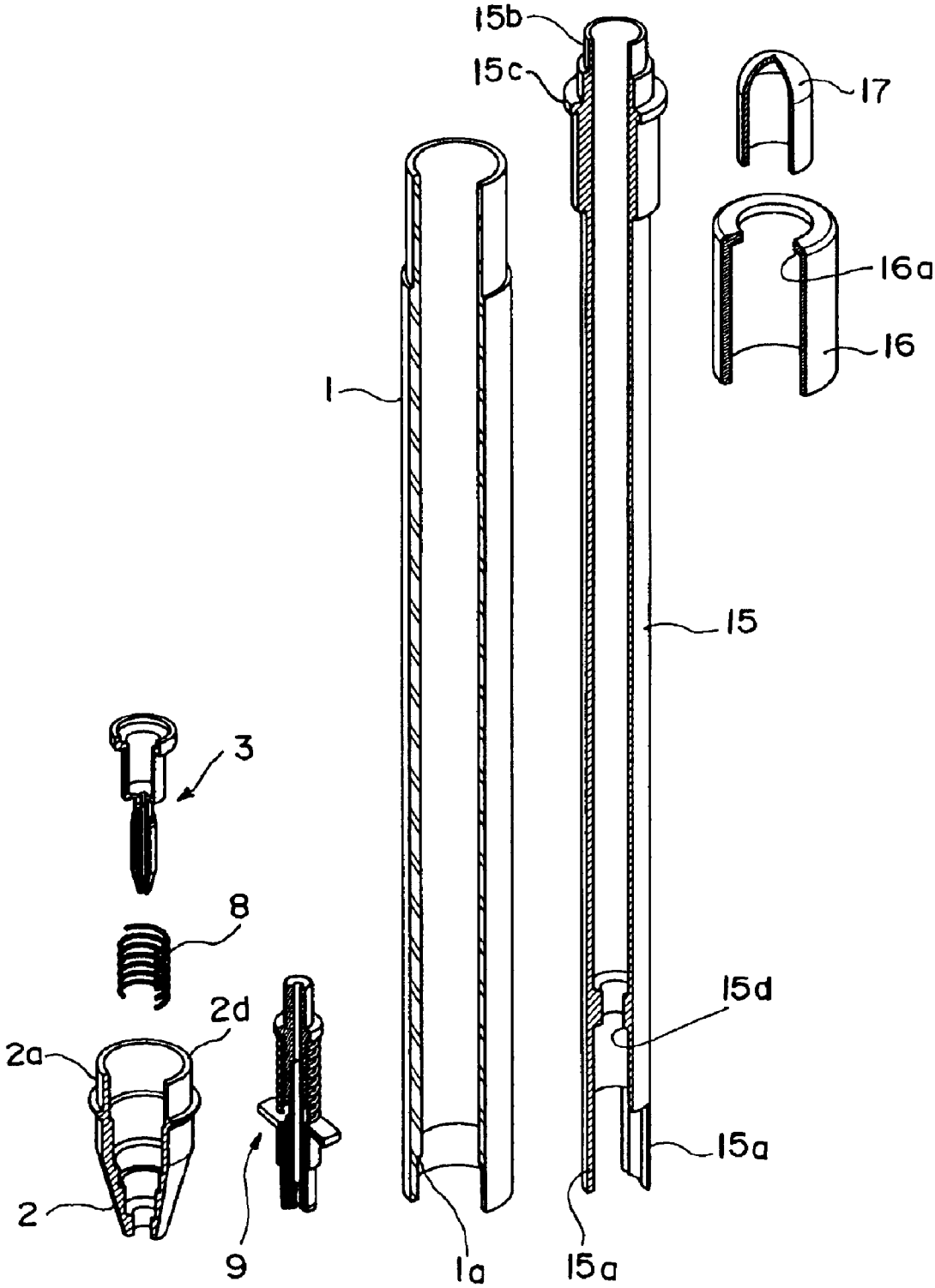
FIG. 2 is a perspective view showing components of FIG. 1.

A mechanical pencil in the first embodiment comprises, as shown in FIGS. 1 and 2, a shaft tube 1, a tip 2, a slider 3, a lead gripping mechanism 9, a lead case 15, a knock cover 17, other components and component units. The configuration of the first embodiment is explained below, first relating to the component units of the lead gripping mechanism 9 and slider 3.

Figure 3:
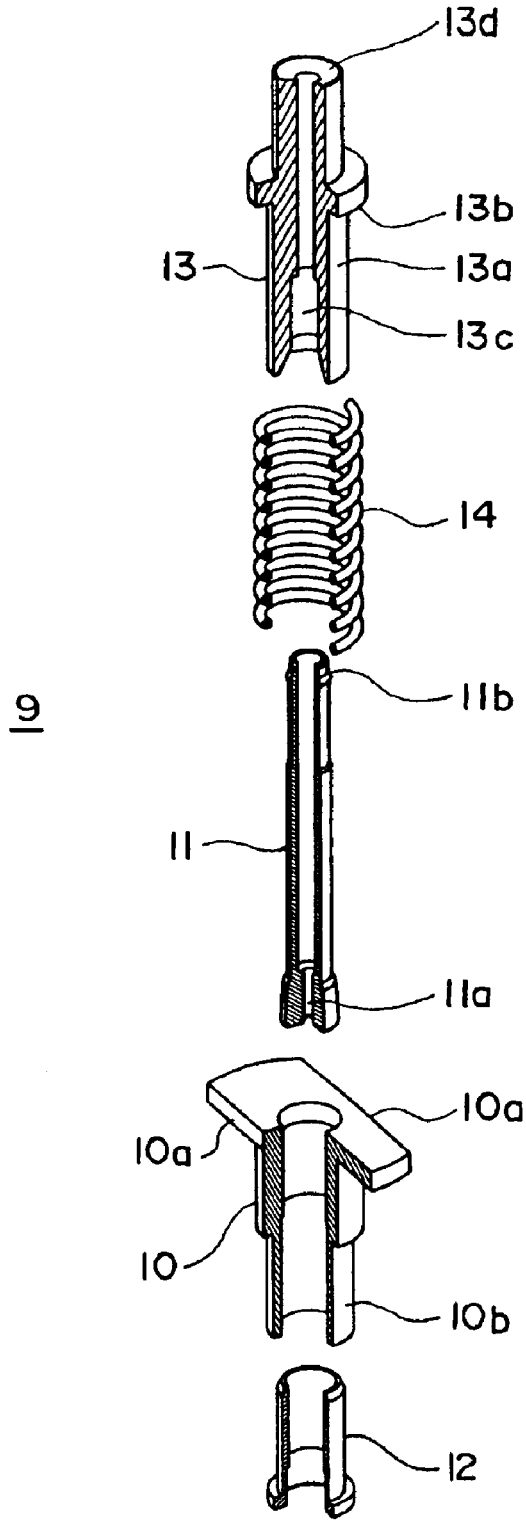
FIG. 3 is a perspective view showing development of components of a lead gripping mechanism.

The lead gripping mechanism 9 is explained. As shown in FIG. 3, the lead gripping mechanism 9 includes a fixing tube 10, a chuck 11, a chuck spring 14, and a chuck joint 13.

The fixing tube 10 has a guide surface 10*a* of cylindrical shape of which both sides are cropped flatly, and a fine end tube 10*b* is formed at the front end. A tightening ring 12 is press-fitted and fixed as tightening part in the inner hole of the end tube 10*b*.

The tightening ring 12 is made of thin metal tubular body in a design to form a slender writing tool on the whole, but it is not always required in the structure of the invention, and it may be integrally formed as tightening part in the inner hole of the end tube 10*b*.

The chuck 11 is same as a chuck used generally in a mechanical pencil, and two-division or three-division slits are formed in the outer circumference of the gripping part 11*a*, and it is formed freely to expand and contract, and a convex engaging portion 11*b* is formed at the rear end of the chuck 11.

The chuck spring 14 is attached to a shaft 13*a* of the chuck joint 13, and the rear end of the chuck spring 14 abuts against the step 13*b*, and the front end abuts against the rear end of the fixing tube 10. In this state, the tightening ring 12 is inserted in the chuck 11, and the chuck 11 is inserted from the front end of the fixing tube 10.

Figure 4:
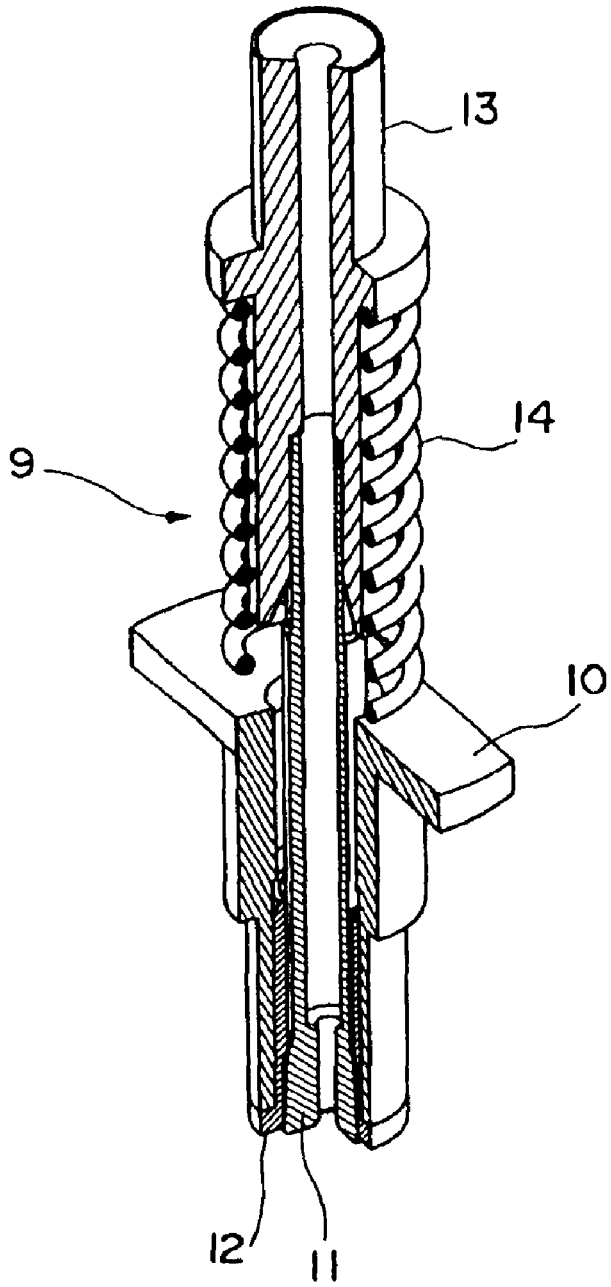
FIG. 4 is a perspective view of an assembled lead gripping mechanism.
Figure 5:
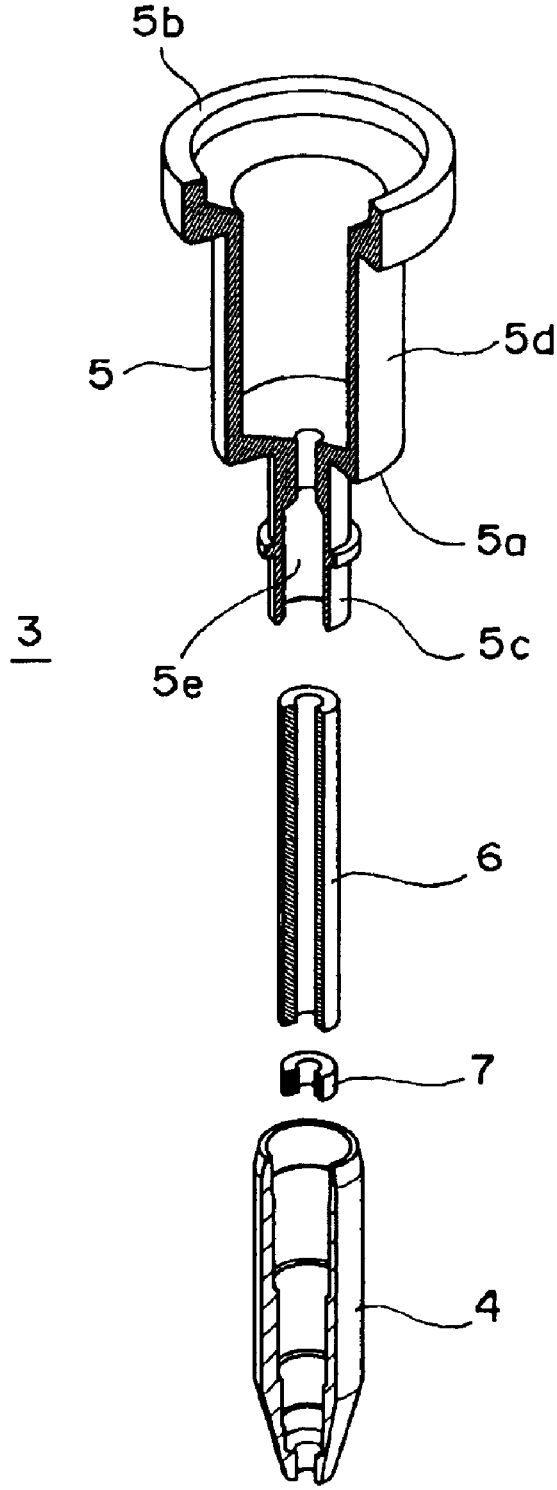
FIG. 5 is a perspective view showing development of components of a slider.

The engaging portion 11*b* of the chuck 11 is press-fitted and engaged in a engaging hole 13*c* at the front end of the shaft 13*a* of the chuck joint 13, and the lead gripping mechanism 9 as shown in FIG. 4 is composed.

The slider 3 is explained with reference to FIGS. 1, 2, 5, and 6.

This slider 3 has a fine tip member 4, a stopper 7, a guide pipe 6, and a rear member 5.

Nearly at the front end of the inner hole of the tip member 4, an elastic stopper 7 is inserted. In the inner hole of the tip member 4, the front part of the guide pipe 6 is fixed so as to arrest the rear end of the stopper 7.

Further, the rear member 5 has a small diameter portion 5*c* and a large diameter portion 5*d*, and the small diameter portion 5*c* and large diameter portion 5*d* are separated by a step 5*a*. A hole 5*e* is formed in the small diameter portion 5*c*, and a circular flange 5*b* is formed behind the large diameter portion 5*d*.

Figure 6:
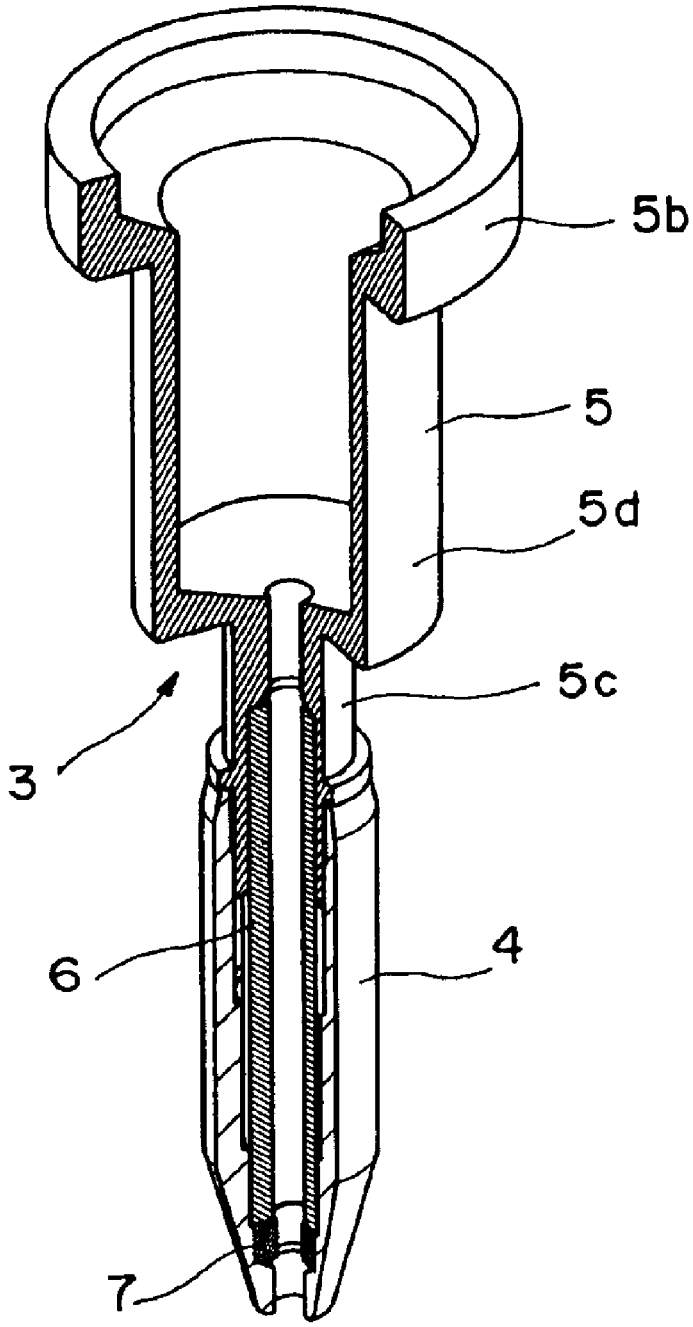
FIG. 6 is a perspective view of an assembled slider.
Figure 7:
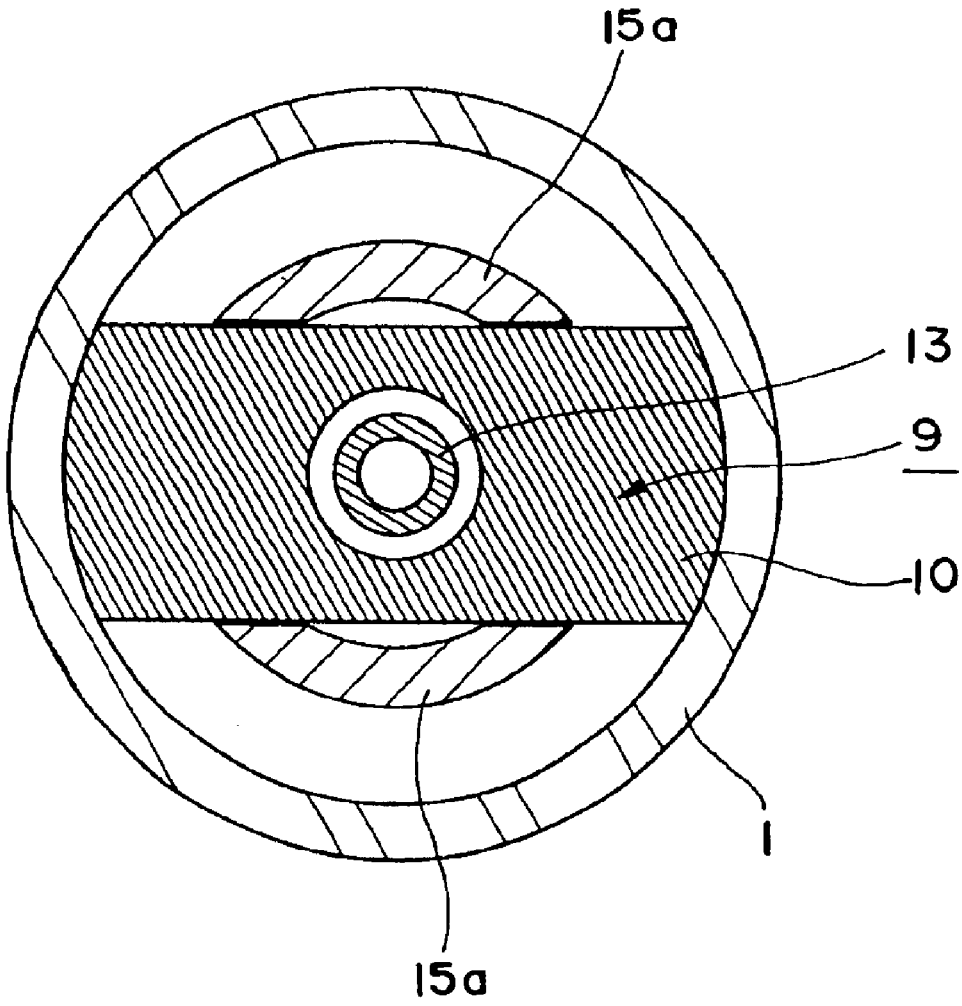
FIG. 7 is a sectional view of lead gripping mechanism.

The rear part of the guide pipe 6 is fixed in the hole 5*e*, and the front end of the small diameter portion 5*c* of the rear member 5 is fixed to the rear end hole of the tip member 4, and the slider 3 as shown in FIG. 6 is composed.

The slider 3 allows the lead to pass by way of the inner hole of the guide pipe 6 and inner hole of the stopper 7, and the leading end of the lead abuts against the rear end of the stopper 7 at equal to or below a predetermined pressure, so that the lead may not be passed in. The stopper 7 is made of elastically dislocating material such as rubber.

The entire structure of the invention is explained with reference to FIGS. 1 to 7, and 13 to 16.

In the lead propelling device in the first embodiment, as shown in FIG. 2, a circular protrusion or circular step 1*a* is formed in the front inner wall of the inner hole of the shaft tube 1.

The lead gripping mechanism 9 is inserted from the front side of the shaft tube 1, and the rear end of the fixing tube 10 is abutted against and fixed to the front part of the step 1*a*. In succession, from behind the shaft tube 1, the lead case 15 is inserted. A pair of opposing legs 15*a* are formed in the front part of the lead case 15. By inserting the lead case 15, the inner side of the leg 15*a* of the lead case 15 is set opposite to the flat guide surface 10*a* of the fixing tube 10 (see FIG. 7).

The lead case 15 is a long tubular body as shown in FIG. 2, having a shaft 15*b* for detachably fixing the knock cover 17 at its rear end, and a flange 15*c* is formed slightly ahead. A step 15*d* is provided at the rear end of the lead case leg 15*a*, and this step 15*d* actuates the chuck joint 13 of the lead gripping mechanism 9 by knocking operation.

With the lead case 15 inserted from behind the shaft tube 1, a crown 16 is attached on the rear end outer periphery of the shaft tube 1.

As shown in FIGS. 1 and 2, the spring 8 is fitted with its rear end abutting against the front side of the step 5*a* of the rear member 5 of the slider 3, the front end of the spring 8 is abutted against the step provided in the inner hole of the tip 2, and the slider 3 is inserted into the inner hole of the tip 2. A threaded part of the shaft 2*a* of the tip 2 is engaged with the threaded part of the shaft tube 1, and the fixing tube 10 is fixed between the rear end 2*d* of the shaft 2*a* and the step 1*a* of the shaft tube 1.

At this time, the rear end of the flange 5*b* of the slider 3 is in contact with the leg 15*a* at the front end of the lead case 15. As mentioned above, since the crown 16 is attached on the rear end outer periphery of the shaft tube 1, the inner step 16*a* at the rear end of the crown 16 abuts against the rear end of the flange 15*c* of the lead case 15, and the lead case 15 is pressed forward.

A knock cover 17 is detachably fitted to the outer periphery of the shaft 15*b* provided at the rear end of the lead case 15.

The fixing tube 10 of the embodiment has a guide surface 10*a* having both sides of cylindrical shape cropped flatly, and the inner side of the leg 15*a* of the lead case 15 is inserted and guided oppositely to the flat guide surface 10*a* of the fixing tube 10, but this guide format may be changed or modified depending on the design.

When the lead case 15 is twisted by force in the rotating direction, to prevent deformation or breakage of the legs 15*a* due to distortion, the lead case 15 may be provided with a rotation stopper. The format of the rotation stopper may be varied depending on the design, and when rotation of the lead case 15 on the shaft tube 1 is prevented, the rotation can be prevented without increasing the number of components.

Figure 8:
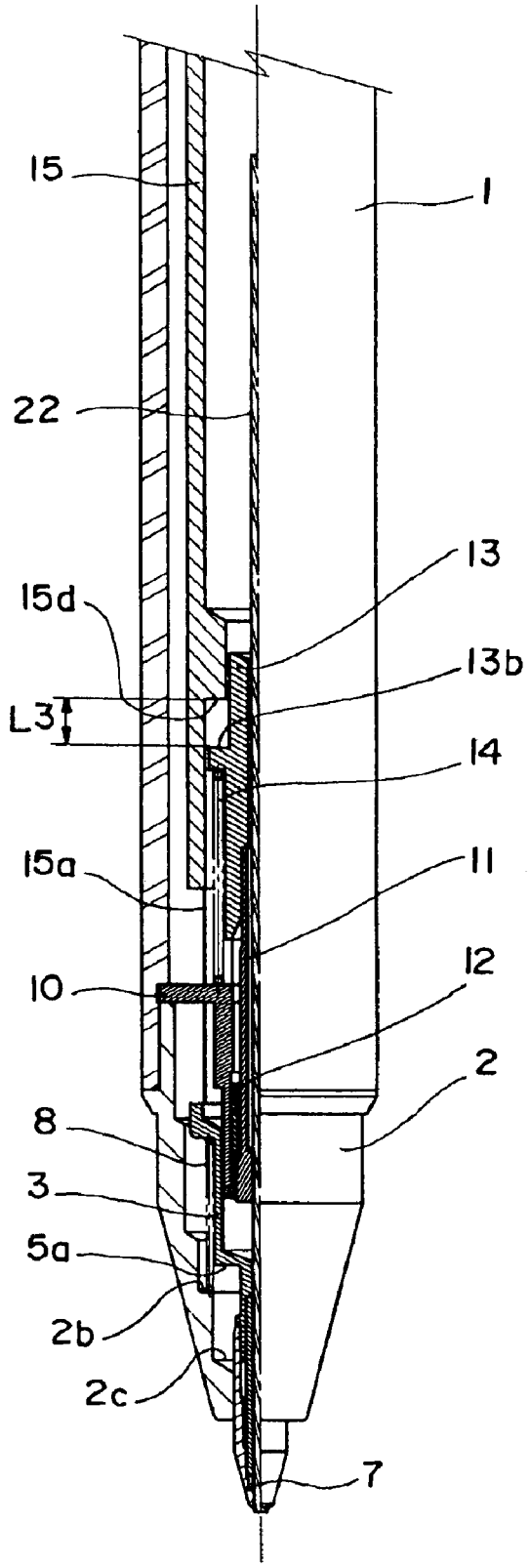
FIG. 8 is an explanatory view of working state of mechanical pencil in the first embodiment, being a sectional view showing writing state.

As mentioned above, the crown 16 is provided on the rear end outer periphery of the shaft tube 1, and when the crown 16 is provided on the shaft tube 1 so as to allow rotation or move, the lead case 15 can be moved forward and backward. Then, by this move of this lead case 15, as shown in FIG. 8, the interval L3 of the step 15*d* of the lead case and step 13*b* of the chuck joint can be expanded or contracted. That is, it can be used as an adjusting device of interval L3.

In this case, the adjusting device generally has a spiral structure, but the mechanism is not limited to this example alone. Moreover, to prevent deviation of adjustment position, a lock mechanism maybe provided, or a display may be provided so that the level of adjustment may be known. Or the crown 16 may be fixed in a state of keeping the interval L3 at an appropriate value.

Figure 13:
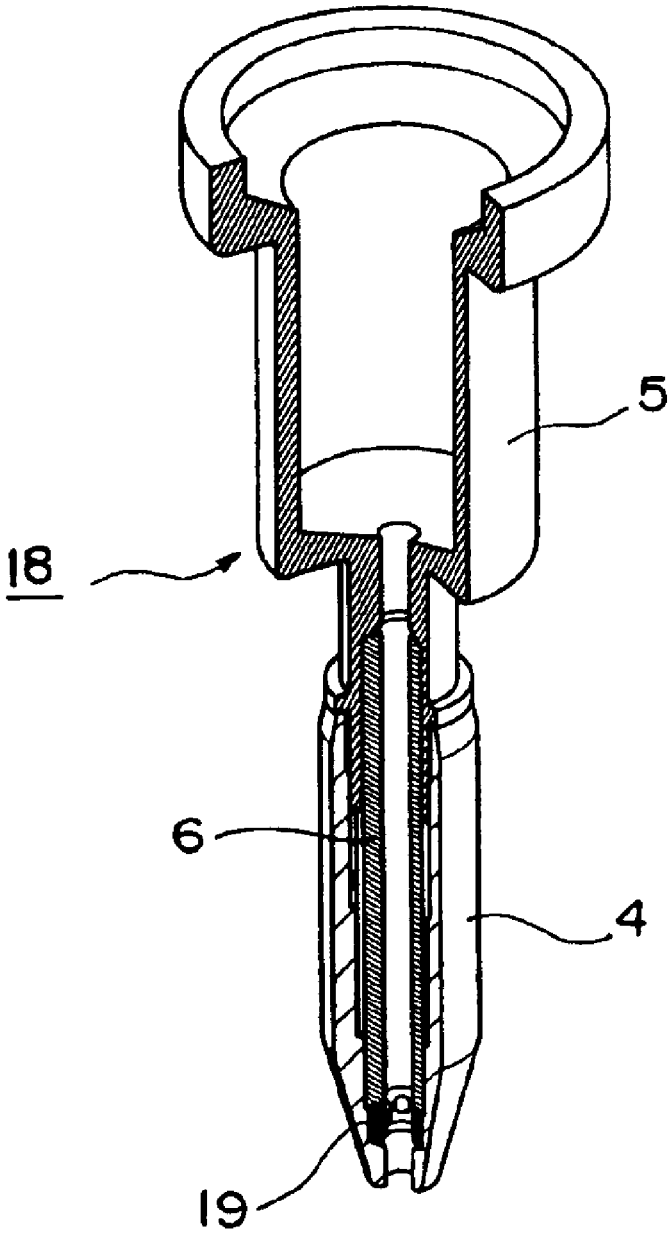
FIG. 13 is a perspective view showing a modified example of slider.
Figure 14:
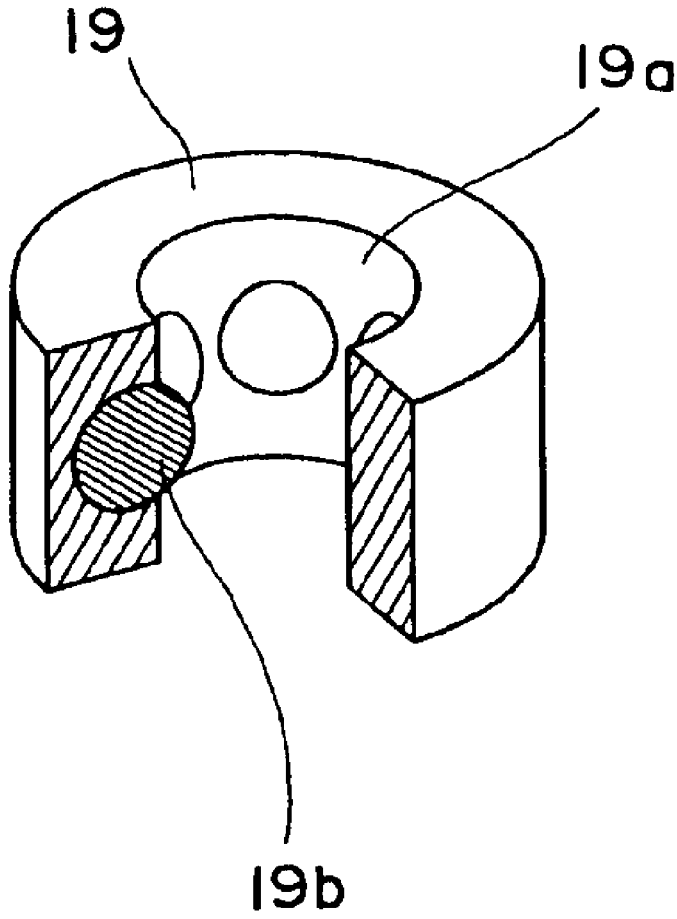
FIG. 14 is a perspective view of stopper used in the slider shown in FIG. 13.

Referring now to FIG. 13, a slider 18 is explained as a modified example of the slider 3. This slider 18 is basically same in structure as the slider 3, and differs only in the composition of a stopper 19. As shown in FIG. 14, the stopper 19 has a plurality of hard parts 19*b* provided in the inner hole circumference of the elastic part 19*a*.

Accordingly, with the leading end of the lead abutting against the hard parts, and a predetermined pressing force applied to the leading end of the lead, the lead can be passed through. For example, the elastic part 19*a* is formed of rubber or similar material, and the hard part 19*b* is made of spherical or irregular metal or nonmetallic particle.

Figure 15:
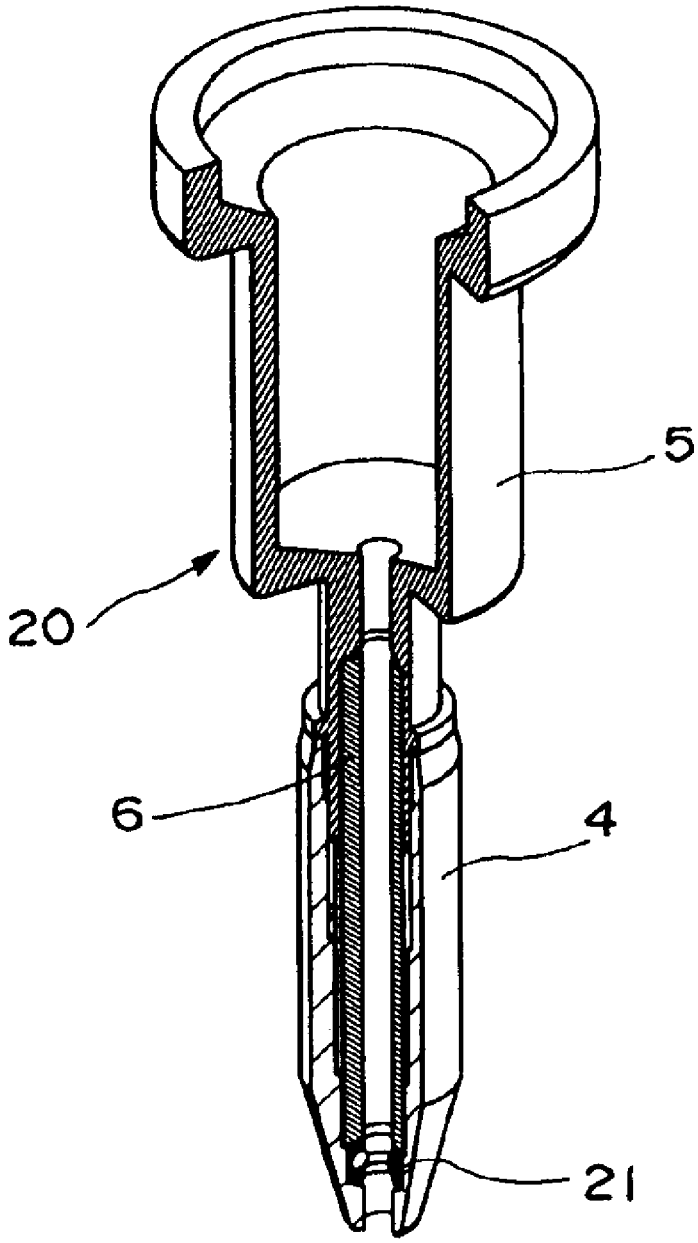
FIG. 15 is a perspective view showing a modified example of slider.
Figure 16:
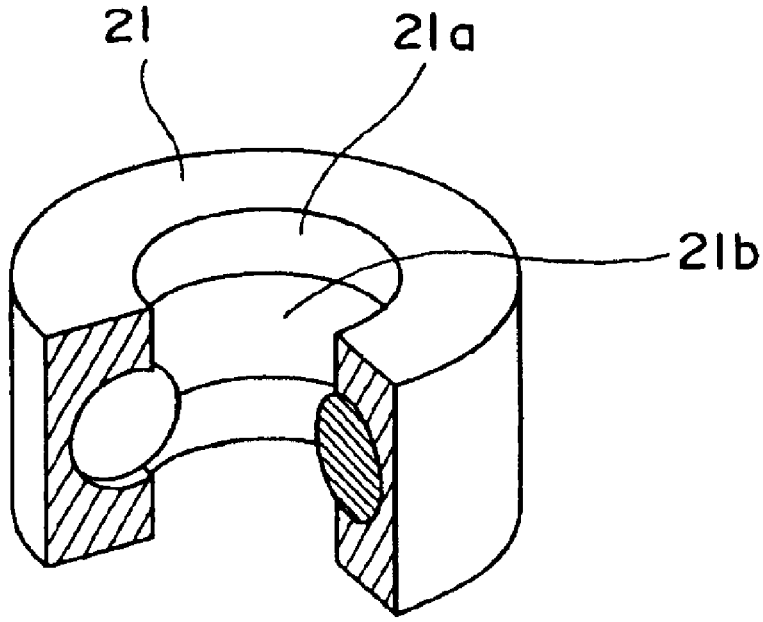
FIG. 16 is a perspective view of stopper used in the slider shown in FIG. 15.

With reference to FIG. 15, a slider 20 is explained as a modified example of the slider 3. The slider 20 also differs in the structure of a stopper 21 only. The stopper 21 has a ring-shaped hard part 21*b* provided in the inner hole periphery of the elastic part 21*a*. Accordingly, with the leading end of the lead abutting against the hard part 21*b*, and a appropriate pressing force applied to the leading end of the lead, the lead can pass through. The hard part 21*b* of the stopper 21 is made of metal or nonmetallic C-ring, and is fixed in the concave groove of the inner hole of the elastic body 21*a*.

The stopper is not particularly specified in structure as far as it is made of spring material of metal or nonmetallic material and the lead can pass through with a predetermined pressure applied to the leading end of the lead.

The mechanical pencil of the embodiment is thus configured, but is not particularly specified in the format of the component units and components. For example, the slider 3 is composed of multiple components, but it can be also made of a single element in an extreme case. A leg may be provided in the rear part of the slider, and the leg rear end face and the lead case front end face may contact with each other. Alternatively, by the spring 8 provided between the tip 2 and the slider 3, the lead case 15 is biased backward together with the slider 3, but the spring 8 can be also provided behind the shaft tube 1. By coupling and fixing the slider and lead case, the lead case may be biased backward by the spring.

Best modes may be set depending on the design.

Referring to FIGS. 8 to 12, the operation of the lead propelling device of the first embodiment is explained.

FIG. 8 shows an initial state before knocking operation in writing state. In this state, the chuck 11 is biased backward by the chuck spring 14, and the lead 22 is gripped, and the lead case 15 and slider 3 are integrally pushed backward by the spring 8. Here, the strength of the spring 8 and chuck spring 14 can be set independently. Therefore, the strength of the chuck spring 14 can be set to a proper strength for gripping the lead.

In this state, as mentioned above, the lead 22 is gripped by the chuck 11, and projected from the slider 3, and it is ready to write.

When the lead is worn out in writing state in FIG. 8, the rear end (knock cover 17) of the lead case 15 is knocked. An initial state upon start of knocking (the state of moving the lead case 15 by distance L3) is shown in FIG. 9.

When knocking starts, the lead case 15, integrally with the slider 3, begins to compress the spring 8. As shown in FIGS. 8 and 9, when the spring 8 is compressed by the distance L3 between the lead case step 15*d* and the chuck joint step 13*b*, the lead case step 15*d* abuts against the chuck joint step 13*b*.

At this time, the lead 22 is fixed in a state being gripped by the chuck 11, and the tip 4 of the slider 3 moves forward, and the stopper 7 goes through at a front portion of the lead 22.

Figure 9:
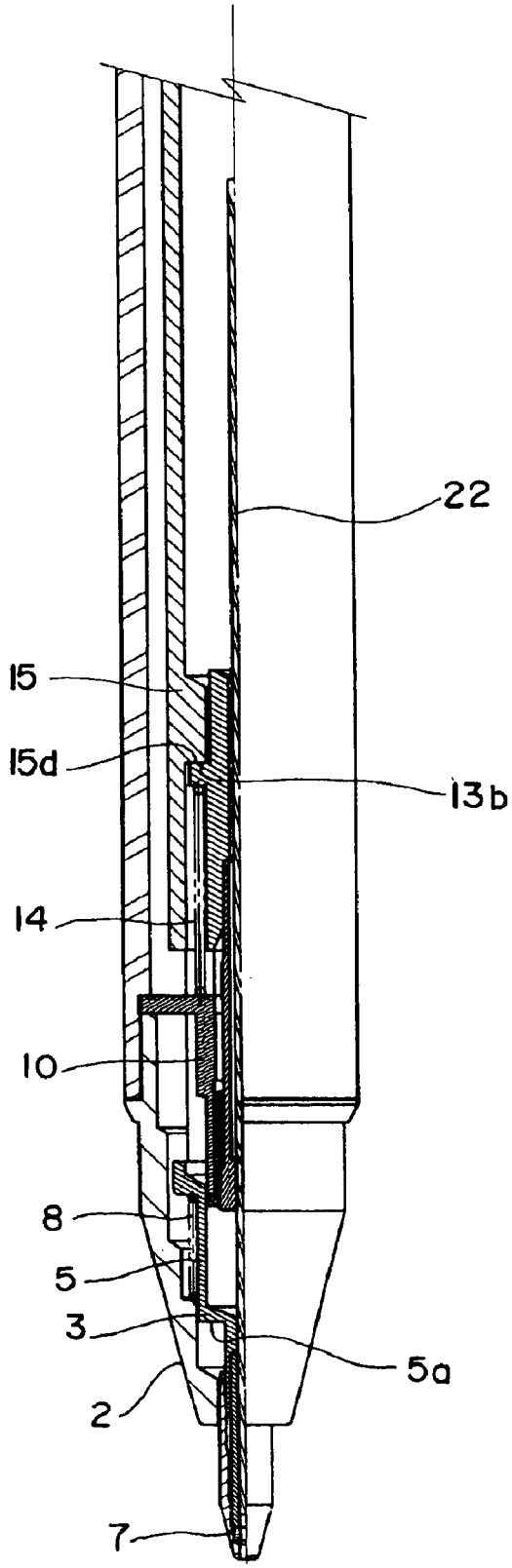
FIG. 9 is an explanatory view of working state of mechanical pencil in the first embodiment, being a sectional view showing knocking initial state of stopper clearing lead gripping.
Figure 10:
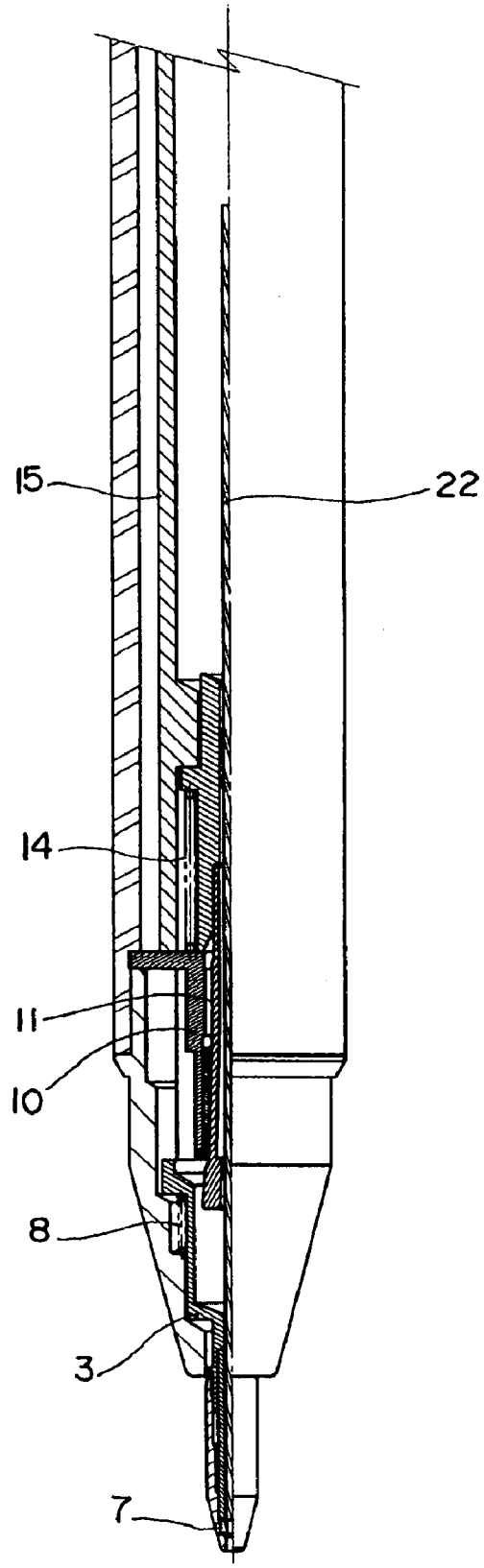
FIG. 10 is an explanatory view of working state of mechanical pencil in the first embodiment, being a sectional view showing full knocking state of chuck releasing the lead.

When further knocked from the state in FIG. 9, since the slider 3 and lead case 15 are in interlock, while continuing compression of the spring 8, compression of the chuck spring 14 begins. In this state, the chuck 11 also begins to move forward, and gripping of the lead 22 is released, and the step 5*a* of the rear member 5 abuts against the tip step 2*c* to be set in full knocking state. In the full knocking state, the lead 22 is released from the chuck 11 and stopper 7, and the lead falls spontaneously by the own weight of the lead, and abuts against the rear end of the stopper 7. FIG. 10 shows a full knocking state of releasing the lead 22.

When knocking is released from full knocking state, the lead 22, slider 3, lead case 15, and chuck 11 begin to move backward all together. The chuck 11 is pulled to the tightening ring 12 of the fixing tube 10 by the chuck spring 14, and gripping of the lead 22 is complete (see FIG. 11).

When further released from knocking, the chuck 11 stops moving backward by means of the fixing tube 10, and maintains the lead gripping state. On the other hand, the lead case 15 and slider 3 continue to move backward. At this time, the lead case step 15*d* returns to the initial state to the distance L3 to the chuck joint step 13*b*.

Figure 12:
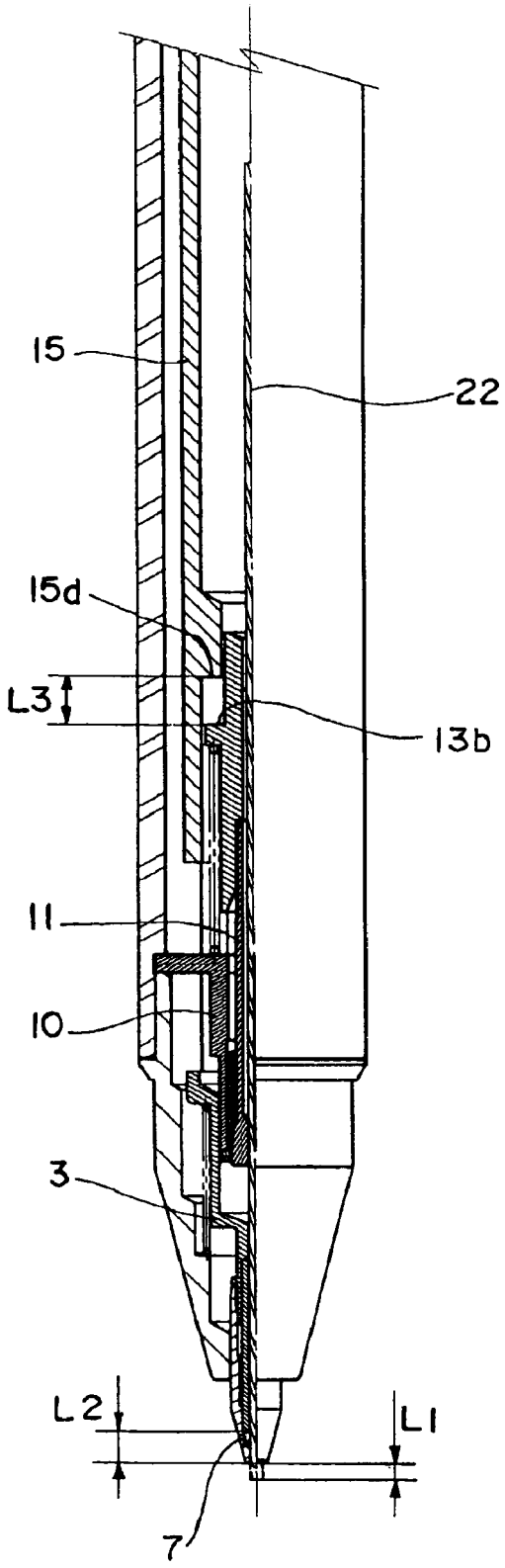
FIG. 12 is an explanatory view of working state of mechanical pencil in the first embodiment, being a sectional view showing state of projection of leading end of lead by a proper length from the front end of a tip member after retreat of lead case to initial state.

The lead 22 gripped by the chuck 11 penetrates through the stopper 7 as the slider 3 and lead case 15 further move backward, and projects from the leading end of the slider 3 by distance L1 (see FIG. 12). That is, L1=L3−L2.

Figure 11:
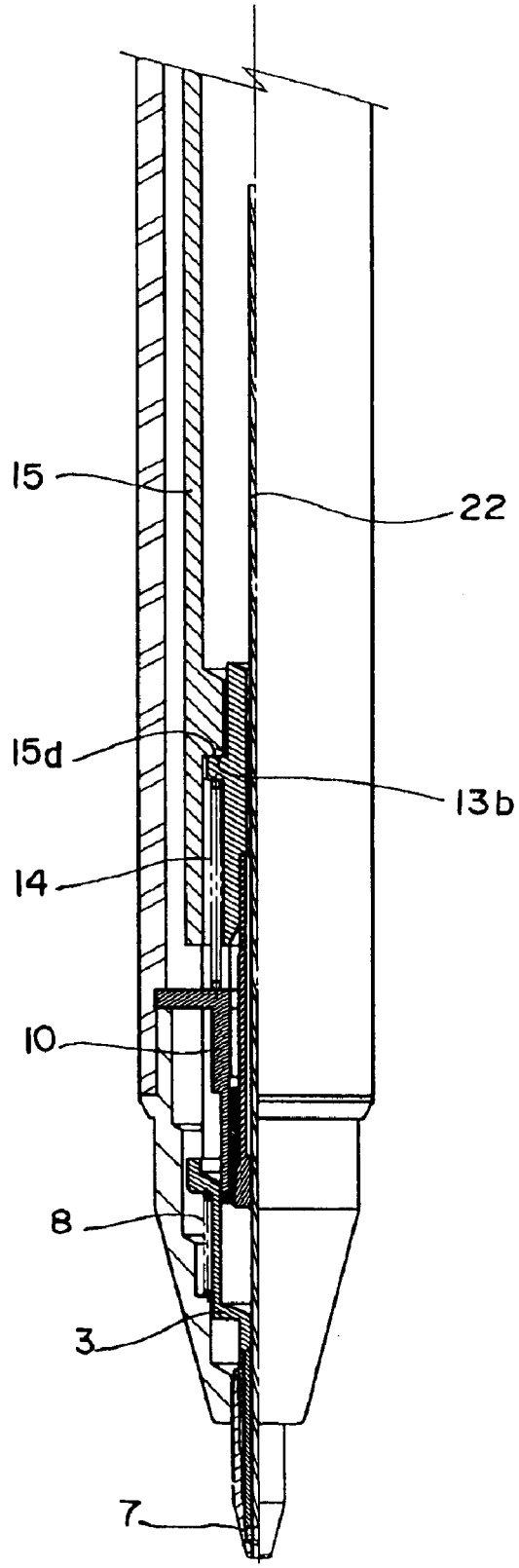
FIG. 11 is an explanatory view of working state of mechanical pencil in the first embodiment, being a sectional view showing state of lead gripped again by chuck after retreat of lead case.

In this state, if knocked again, as the lead case 15 moves by distance L3, as shown in FIG. 9, the stopper 7 goes through at a front portion of the lead 22. As a result, the state as shown in FIGS. 10 to 12 is established.

Thus, even if the knocking operation is repeated, by repeating the motion shown in FIGS. 9 to 12, the lead 22 projects from the slider 3 only by the specified extent. If the lead 22 is worn out by writing, by this operation, the lead can be projected from the slider 3 by the predetermined length.

A second embodiment is explained with reference to the accompanying drawings. FIGS. 17 to 35 show a lead propelling device in the second embodiment of the invention.

Figure 17:
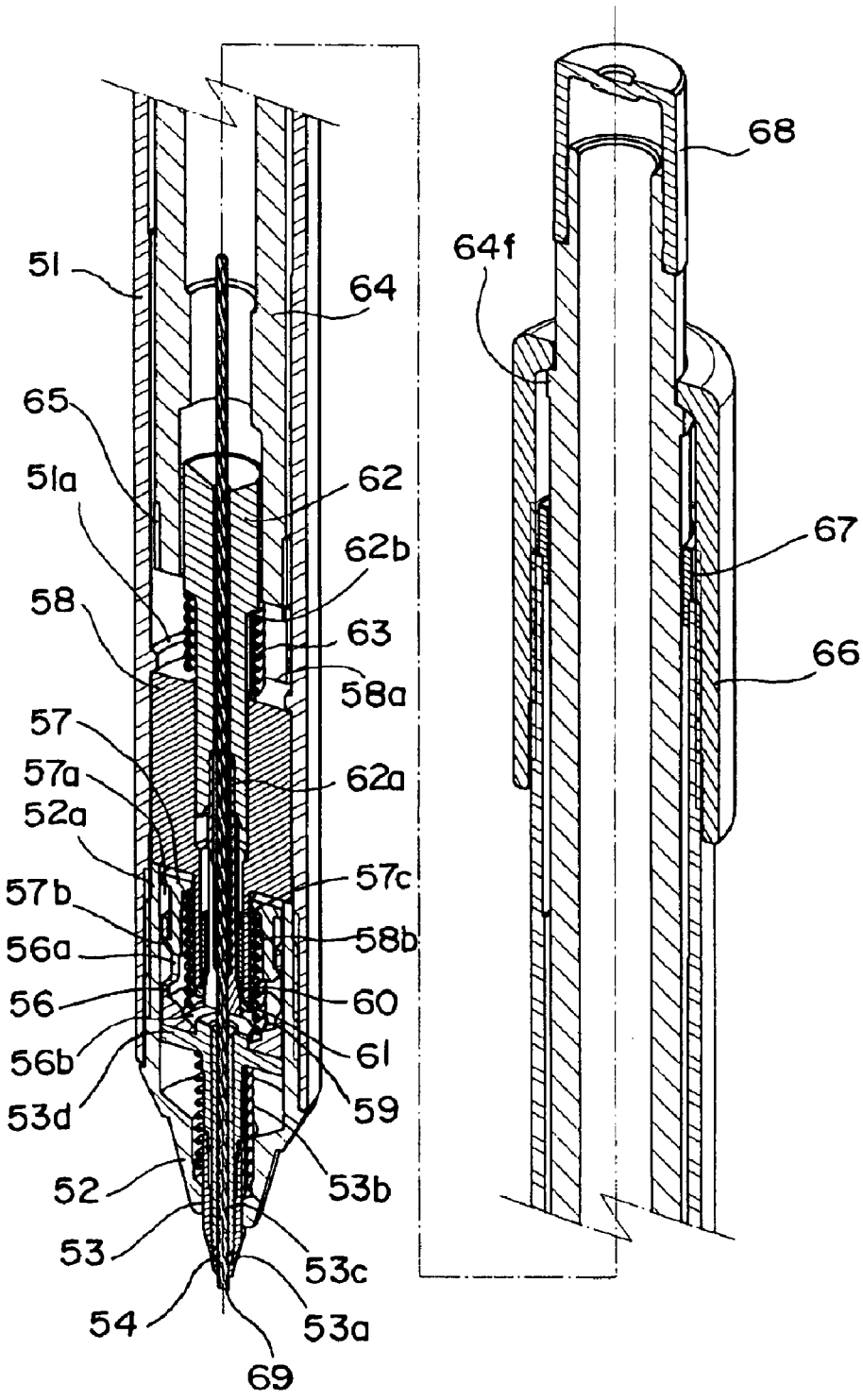
FIG. 17 is a general longitudinal sectional perspective view of a lead propelling device in a second embodiment of the invention.
Figure 18:
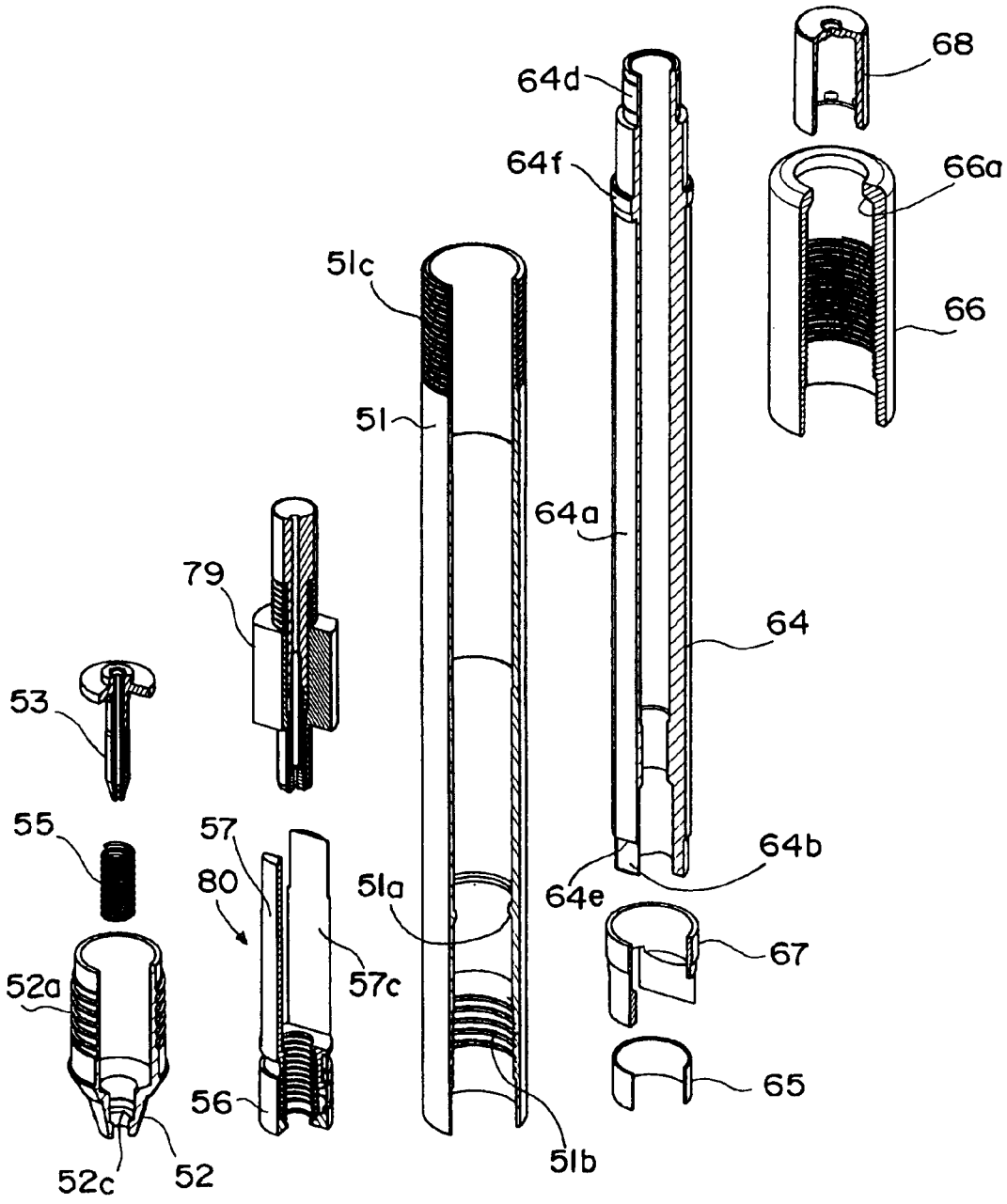
FIG. 18 is a perspective view showing component unit, components, and others of lead propelling device in the second embodiment.

A mechanical pencil in the second embodiment comprises, as shown in FIGS. 17 and 18, a shaft tube 51, a tip 52, a slider 53, a lead gripping mechanism 79, a lead case 64, a knock cover 68, and other components and component units. In the second embodiment, first of all, the component units of the lead gripping mechanism 79, link unit 80, and slider 53 are explained below.

The lead gripping mechanism 79 is explained with reference to FIGS. 17, 18, 19, and 20.

Figure 19:
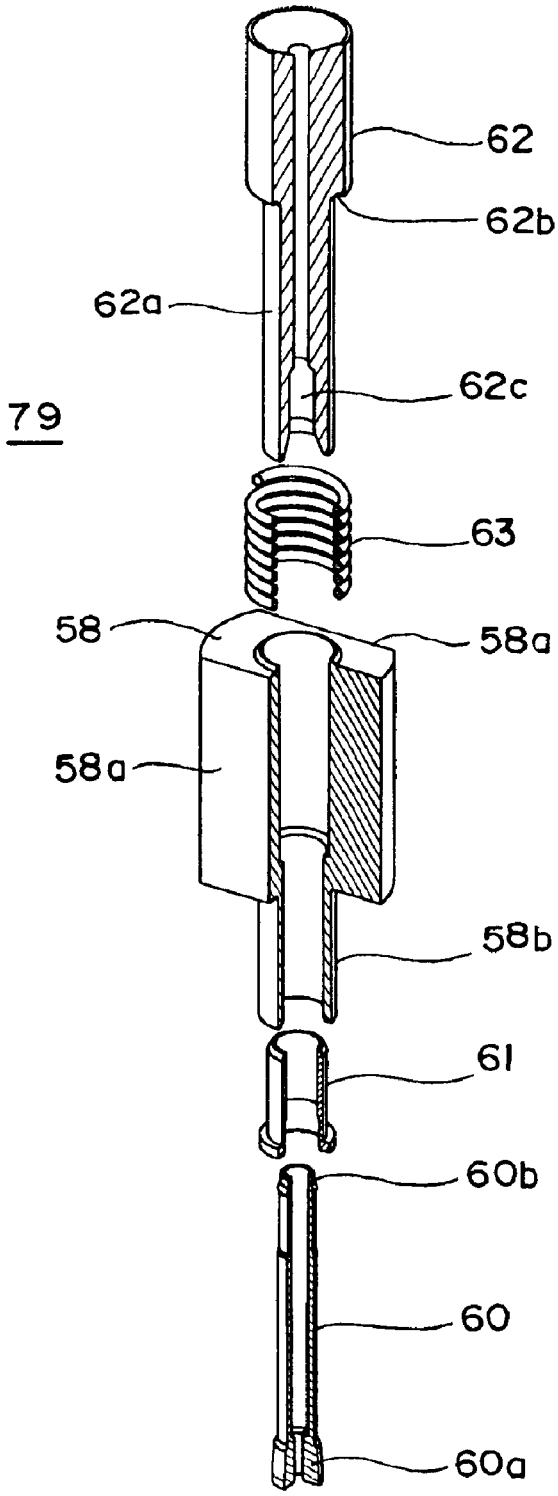
FIG. 19 is a perspective view showing development of components of lead gripping mechanism.

As shown in FIG. 19, a fixing tube 58 has a guide surface 58*a* of cylindrical shape of which both sides are cropped flatly, and a fine end tube 58*b* is formed at the front end. A tightening ring 61 is press-fitted and fixed as tightening part in the inner hole of the end tube 58*b*.

The tightening ring 61 is made of thin metal tubular body in a design to form a slender writing tool on the whole, but it is not always required in the structure of the invention, and it may be integrally formed as tightening part in the inner hole of the end tube 58*b*.

The chuck 60 is same as a chuck used generally in a mechanical pencil, and two-division or three-division slits are formed in the outer circumference of the gripping part 60*a*, and it is formed freely to expand and contract, and a convex engaging portion 60*b* is formed at the rear end of the chuck 60.

The gripping mechanism 79 is composed as follows. A chuck spring 63 is fitted to a shaft 62*a* of a chuck joint 62, the rear end of the chuck spring 63 is abutted against the step 62*b*, and the front end abuts against the rear end of the fixing tube 58. In this state, by inserting the chuck 60 into the tightening ring 61, and the chuck 60 is inserted from the front end of the fixing tube 58.

Figure 20:
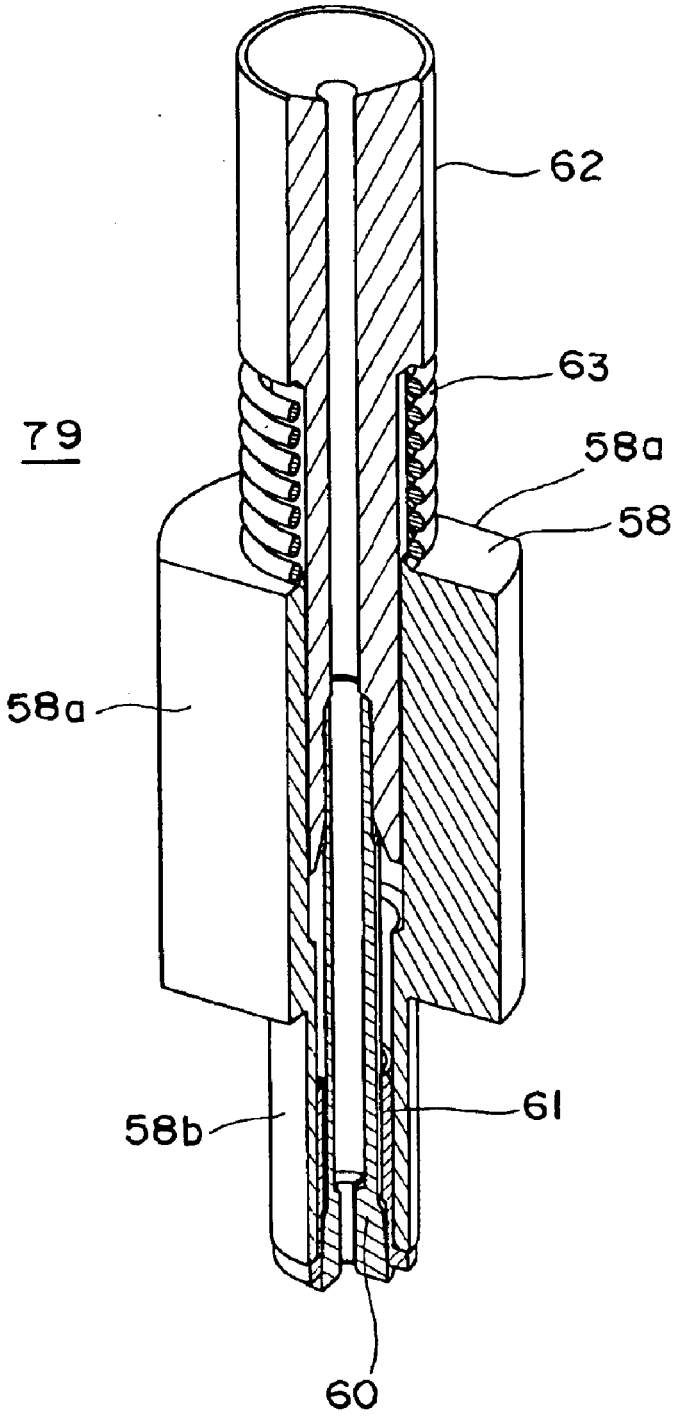
FIG. 20 is a perspective view of assembled lead gripping mechanism.

By press-fitting and engaging the engaging portion 60*b* of the chuck 60 into a engaging hole 62*c* provided at the front end of the shaft 62*a* of the chuck joint 62, the lead gripping mechanism 79 shown in FIG. 20 is composed.

The link unit 80 is explained with reference to FIGS. 17, 18, 21, and 22.

Figure 21:
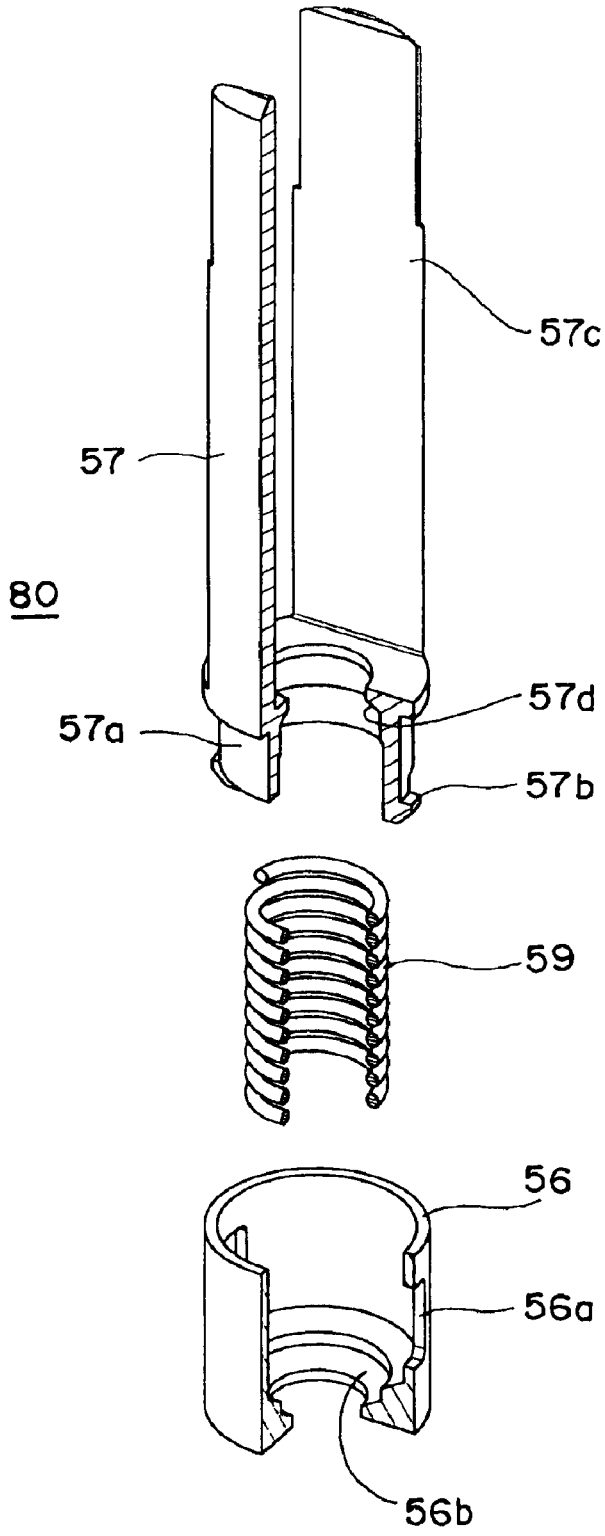
FIG. 21 is a perspective view showing development of components of link unit.

The link unit 80 is composed of link 57, link spring 59, and link joint 56 as shown in FIG. 21.

The link 57 has legs 57*c* flat at the inner side and extended long backward, formed at two positions along the outer periphery of the rear end of a tubular part 57*a*. An inner step 57*d* is provided at the inner hole rear end of the tubular part 57*a*, and hook-shaped engaging portions 57*b* are formed at two leading end positions of the tubular part 57*a*.

The link joint 56 is a tubular body, and slits 56*a* are opened at two side positions, and an inner step 56*b* is provided at the front end.

Figure 22:
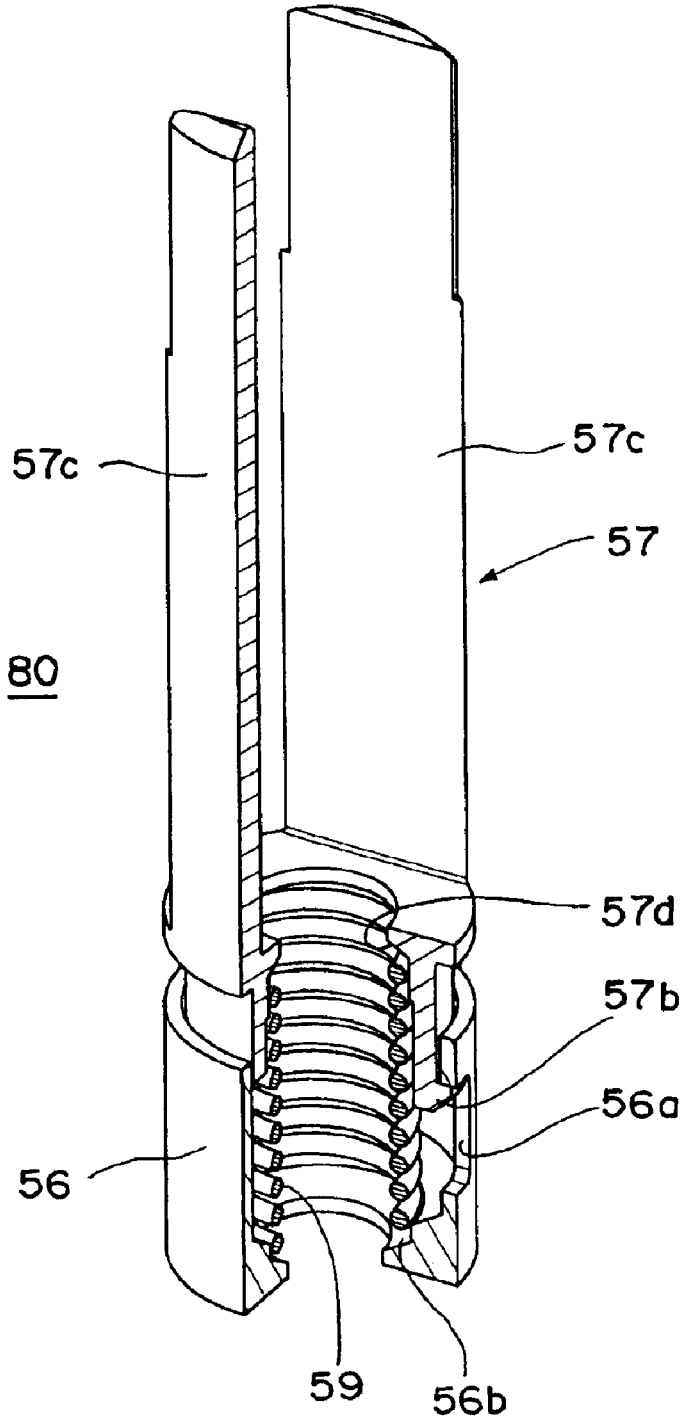
FIG. 22 is a perspective view of assembled link unit.

The front end of the link spring 59 abuts against the inner step 56*b* of the link joint 56, and the rear end abuts against the inner step 57*d* of the link 57, and in this state the engaging portion 57*b* is elastically fitted and engaged in the slit 56*a*. As a result, the link unit 80 shown in FIG. 22 is composed.

The slider 53 is explained with reference to FIGS. 17, 18, 23, and 24.

Figure 23:
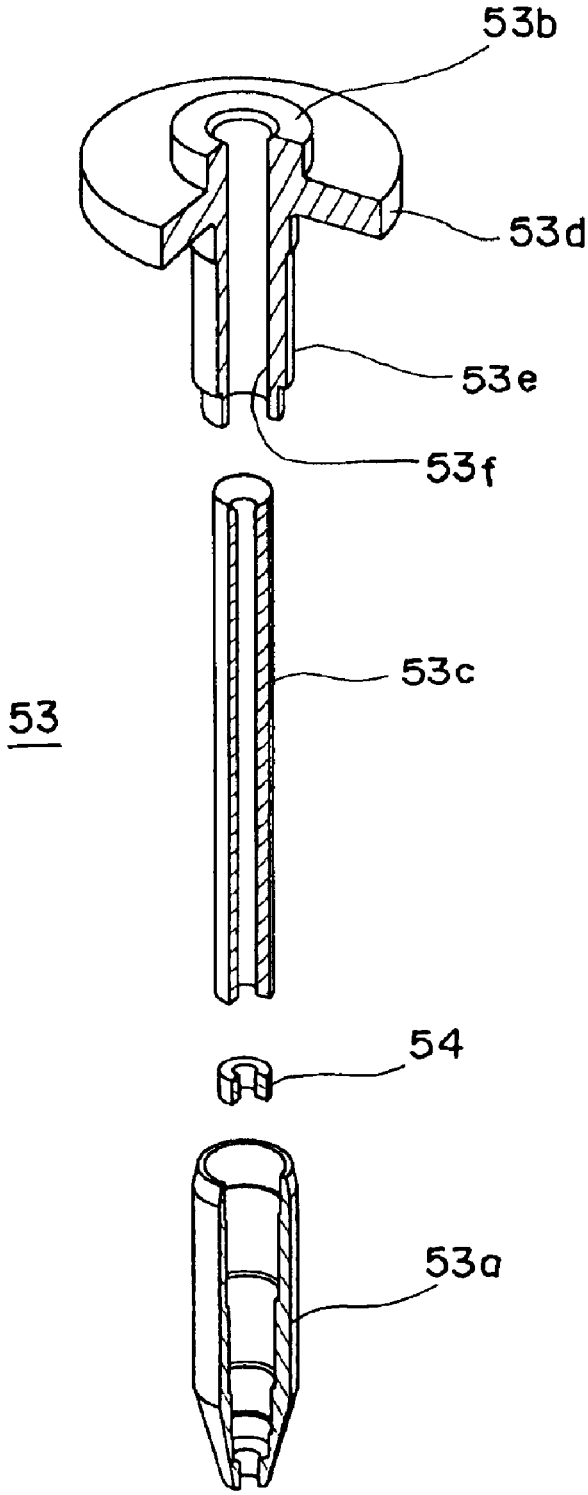
FIG. 23 is a perspective view showing development of components of slider.

This slider 53 is composed of, as shown in FIG. 23, a rear member 53*b*, a guide pipe 53*c*, a stopper 54, and a tip member 53*a*.

The slider 53 has the stopper 54 made of an elastic material provided nearly at the front end of the inner hole of the fine tip member 53*a*. To hold the rear end of the stopper 54, the front part of the guide pipe 53*c* is fixed in the inner hole of the tip member 53*a*.

On the other hand, the rear member 53*b* has a flange 53*d* formed at the rear end, and a shaft 53*e* is integrally formed ahead. The rear part of the guide pipe 53*c* is inserted and fixed in the hole 53*f* of the shaft 53*e* of the rear member 53*b*.

Figure 24:
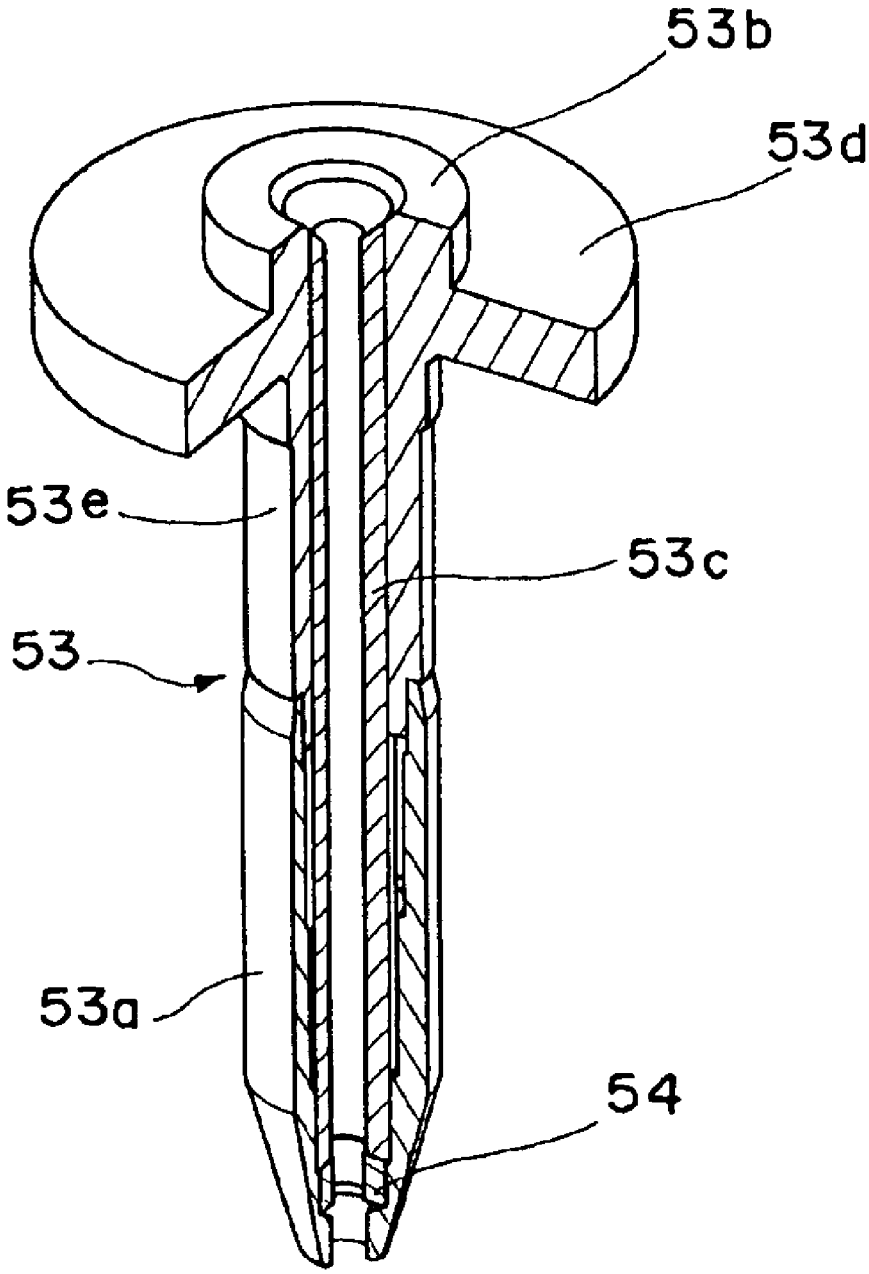
FIG. 24 is a perspective view of assembled slider.

Further, the front end of the rear member 53*b* is inserted and fixed in the rear end hole of the tip member 53*a*, and the slider 53 as shown in FIG. 24 is formed.

The slider 53 allows the lead to be passed by way of the inner hole of the guide pipe 53*c* and inner hole of the stopper 54, but below a predetermined pressure, the leading end of the lead abuts against the rear end of the stopper 54, and it is composed so that the lead may not pass through. This stopper 54 is made of an elastically dislocating material such as rubber.

The entire structure of the invention is described with reference to FIGS. 17, 18, 25, and 26.

In the lead propelling device in the second embodiment, as shown in FIG. 18, a circular protrusion or circular step 51*a* is formed in the front inner wall of the inner hole of the shaft tube 51.

The lead gripping mechanism 79 is inserted from the front side of the shaft tube 51, and the rear end of the fixing tube 58 is abutted and fixed to the front part of the step 51*a*. In succession, the link unit 80 is inserted from the front end of the shaft tube 51. At this time, the inner side of the leg 57*c* of the link 57 is inserted oppositely to the flat guide surface 58*a* of the fixing tube 58.

The lead case 64 is a long tubular body as shown in FIG. 18, having a shaft 64*d* for detachably fixing the knock cover 68 at its rear end, and a flange 64*f* is formed slightly ahead. Flat parts 64*a* are formed at two positions approximately from the front end to near the front end of the tubular body along the periphery, and a further short flat part 64*b* is formed across a step 64*e*.

In the inner hole wall of a rotation stopping ring 67, flat parts are formed at two opposite positions. The rotation stopping ring 67 is fitted from at a front portion of the lead case 64, and the flat part of the rotation stopping ring 67 is fitted oppositely to the flat part 64*a* of the lead case 64. As a result, the rotation stopping ring 67 and the lead case 64 are integral in the rotating direction, and are not deviated in position.

Figure 26:
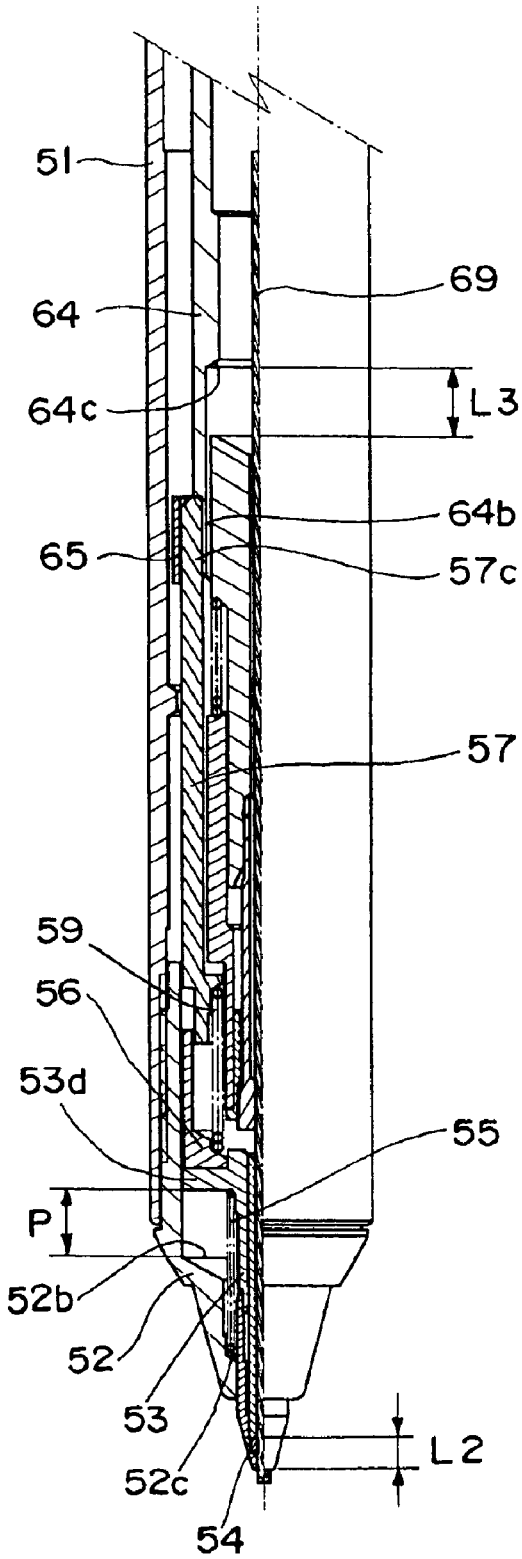
FIG. 26 is a sectional view corresponding to FIG. 25, in section B—B direction in FIG. 27.

Further, as shown in FIG. 26, the inner side of the rear end of the leg 57*c* of the link 57 contacts with the flat part 64*b* of the lead case 64. The rear end outer periphery of the leg 57*c* is press-fitted and in contact with the inner side of the fixing ring 65. As a result, the link 57 and lead case 64 are fixed integrally.

At the front side of the flange 53*d* of the slider 53, a spring 55 is fitted with its rear end abutting against, and the front end of the spring 55 is abutted against the step 52*c* provided in the inner hole of the tip 52.

The slider 53 is inserted into the inner hole of the tip 52, and a threaded part 52*a* of the tip 52 is engaged with a threaded part 51*b* of the shaft tube 51, and a fixing tube 58 is fixed between the rear end of the tip 52 and the step 51*a* of the shaft tube 51.

At this time, the rear end of the flange 53*d* of the slider 53 is abutted against the front end of the link joint 56. As shown in FIG. 17, the front part of the rotation stopping ring 67 is fixed in the rear end hole of the shaft tube 51, and the lead case 64 is prevented from rotating in the rotating direction of the shaft tube 51.

In a threaded part 51*c* of the rear end outer periphery of the shaft tube 51, a crown 66 is engaged and fitted. At this time, by the spring 55, the flange 64*f* of the lead case 64 is pressed into the inner step 66*a* at the rear end of the crown 66.

The fixing tube 58 has a guide surface 58*a* having both sides of cylindrical shape cropped flatly, and the inner side of the leg 57*c* of the link 57 is inserted oppositely to the flat guide surface 58*a* of the fixing tube 58 so as to guide the leg 57*c*, but this guide format may be changed or modified depending on the design. In this embodiment, the separate members of the fixing tube 58 and shaft tube 51 are fixed, and formed integrally, but this fixing tube 58 may be also formed integrally with the shaft tube 51.

The lead case 64 has flat parts 64*a* formed at two positions along the periphery nearly from the front end of the flange 64*f* closely to the front end of the tubular body, and the rotation stopping ring 67 is mounted on the flat part 64*a*. This is, however, not always essential, and it is provided for preventing deformation or breakage of the leg 57*c* of the link 57 due to twisting in case of distortion of the lead case 64 by force in the rotating direction. Accordingly, anything may be used as far as deformation or breakage can be prevented, and the mode of the rotation stopping means may be changed in various modes depending on the design. Further, if the lead case 64 can be directly prevented from rotating on the shaft tube 51, the rotation stopping ring 67 may be omitted.

As mentioned above, the crown 66 is screwed and fitted into the rear end outer periphery of the shaft tube 51. Therefore, by engaging with the crown 66 and rotating and moving the crown 66 on the shaft tube 51, the lead case 64 can be moved forward and backward. By such move of the lead case 64, the slider 53 can be moved. As a result, as shown in FIG. 26, the interval P between the front side of the flange 53*d* of the slider 53 and the inner step of the tip 52 can be expanded or contracted. That is, rotation or moving of the crown 66 on the shaft tube 51 is a kind of an adjusting device of the interval P.

Such adjusting device is generally a screwed structure of shaft tube 51 and crown 66, but the mechanism is not limited to this structure alone. Further, a lock mechanism may be provided so as not to deviate the adjustment position, or a display device may be provided so that the level of adjustment may be known.

Meanwhile, the crown 66 may be fixed in a state of setting the interval P at an appropriate value.

The lead propelling device of the embodiment is thus configured, but is not particularly specified in the format of the component units and components. For example, the slider 53 is composed of multiple components, but it can be also made of a single element in an extreme case. The rear member 53*b* of the slider and the link joint 56 may be formed as one part.

In the embodiment, a link spring 59 is placed between the inner steps of the link joint 56 and link 57, and when a pressure is applied to the link joint 56 by more than a predetermined strength for the link 57, there is an action part for allowing the link 57 to advance on the link joint 56. But by forming the link joint 56 and link 57, a similar action part may be provided between the link rear part and front part of the lead case. Anyway, an optimum mode may be selected depending on the design.

Figure 25:
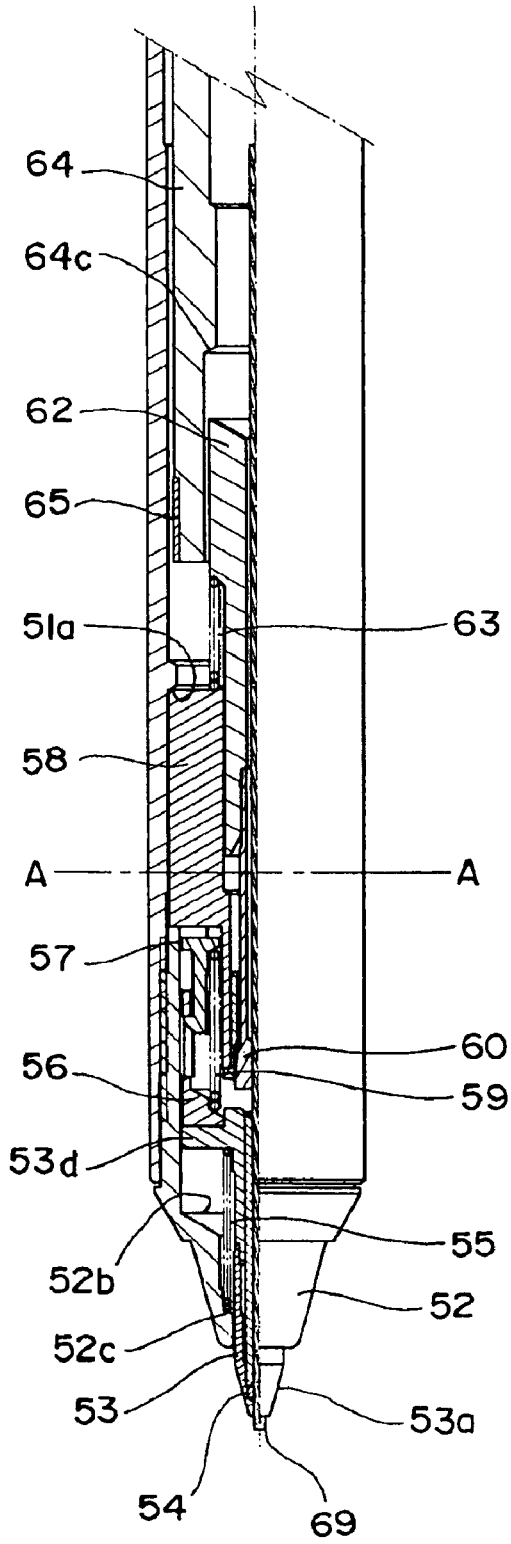
FIG. 25 is an explanatory view of working state of the lead propelling device in the second embodiment, being a sectional view showing slightly projecting state of lead to the leading end of tip member of slider.
Figure 27:
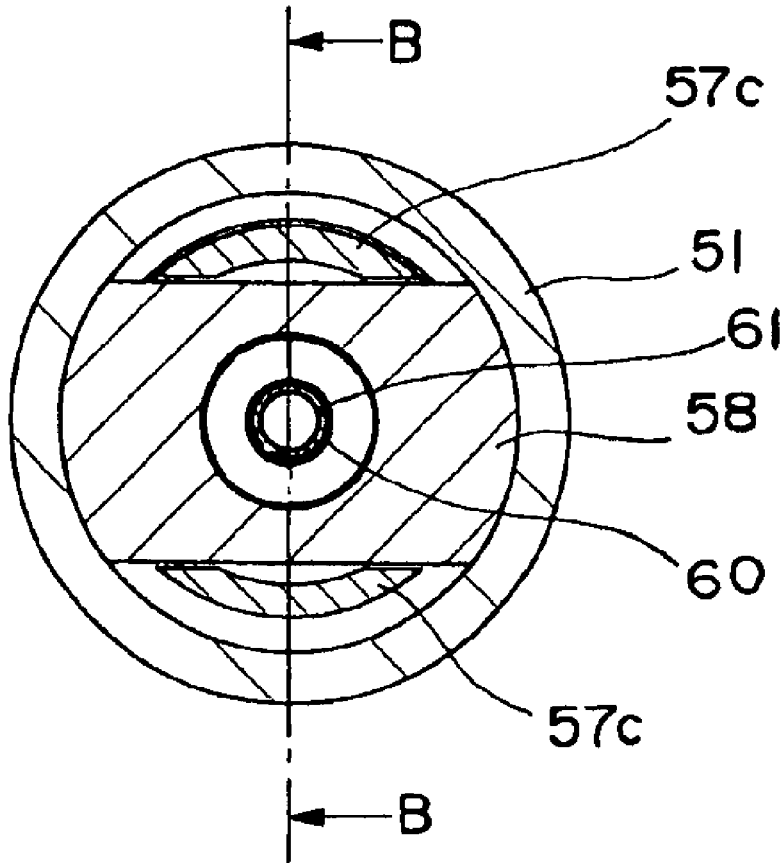
FIG. 27 is a section A—A view in FIG. 25.

Then, referring to FIGS. 25 to 35, the operation of the lead propelling device in the second embodiment is described. FIG. 25 shows an initial state of operation of the leading end of the lead 69 projecting slightly to the leading end of the tip 53*a* of the slider. FIG. 27 is a section A—A view of FIGS. 25, and 26 is a sectional view corresponding to FIG. 25 in the section B—B direction of FIG. 27. That is, FIGS. 25 and 26 show sections deviated by 90° from each other.

First, as shown in FIG. 26, in this lead propelling device, the interval of the front side of the flange 53*d* of the slider 53 and the inner step 52*b* behind the tip 52 is set at P, the interval of the rear end of the stopper 54 and the front end of the end member 53*a* is set at L2, and the interval of the inner step 64*c* formed in the front inner hole of the lead case 64 and the rear end of the chuck joint 62 is set at L3.

Figure 28:
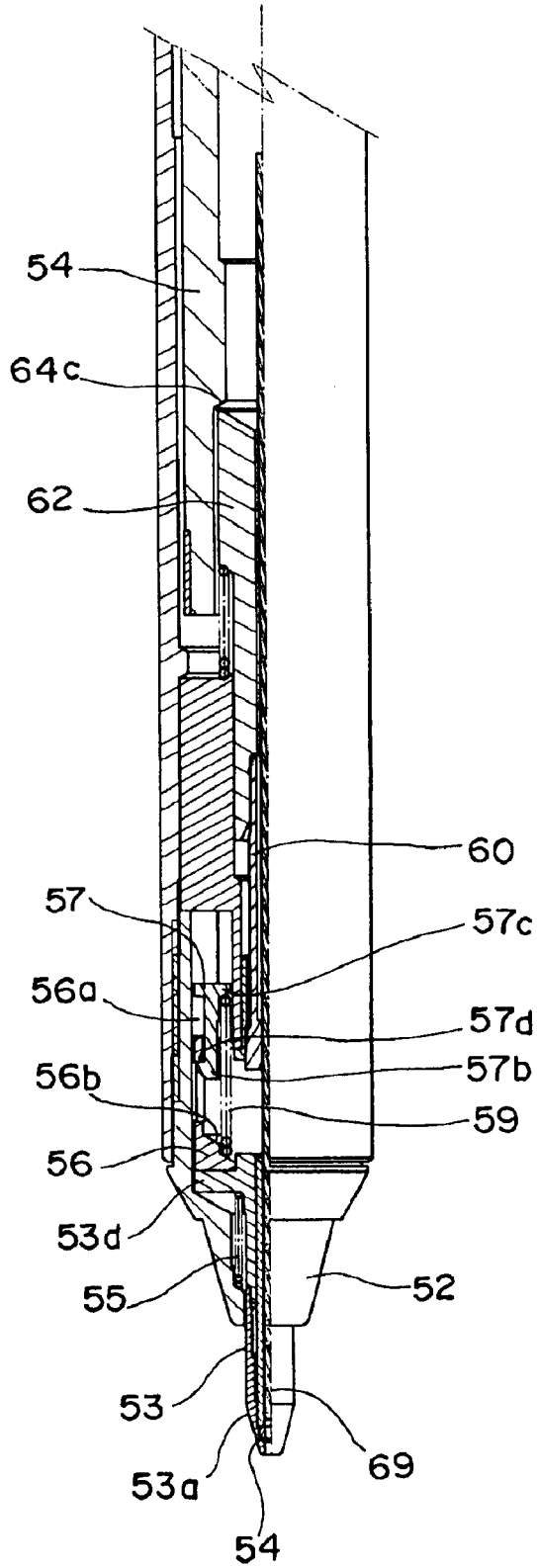
FIG. 28 is a sectional view showing a state of front side of slider flange abutting against the inner step behind the tip by knocking the rear end to advance the lead case.
Figure 29:
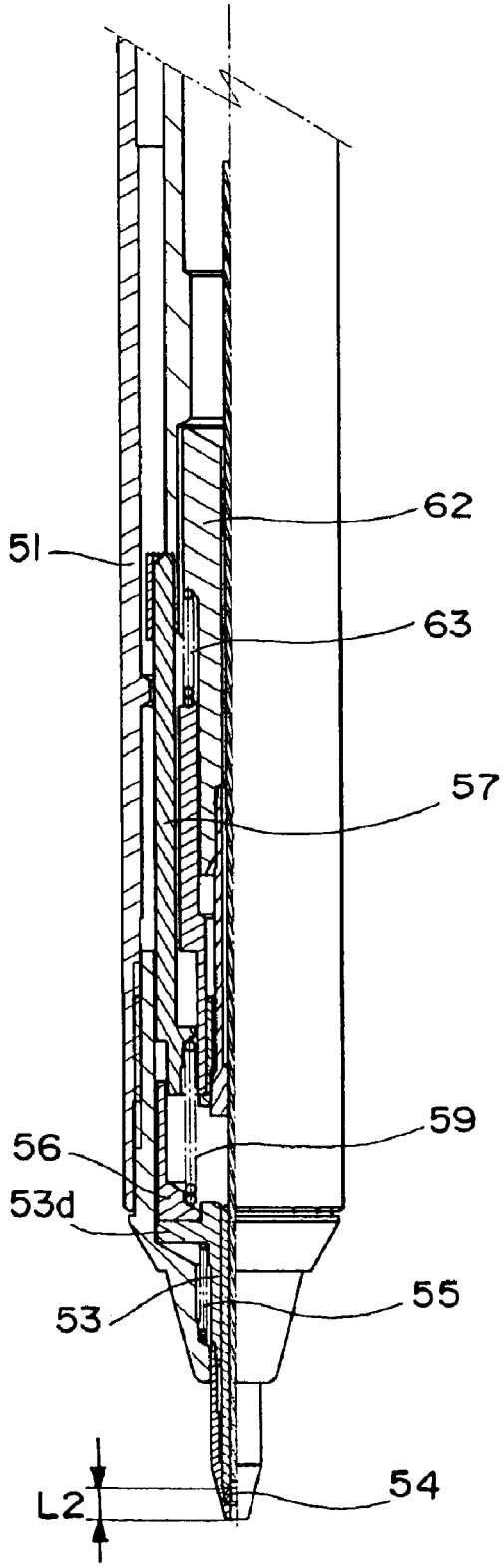
FIG. 29 is a sectional view corresponding to FIG. 28.

In the state shown in FIGS. 25 and 26, by knocking the knock cover 68, the lead case 64 is advanced, and the spring 55 is compressed by way of the link unit 80, and the slider 53 is moved forward. As a result, as shown in FIGS. 28 and 29, the front side of the flange 53*d* of the slider 53 abuts against the inner step 52*b* behind the tip 52. FIG. 29 similarly shows a sectional view deviated by 90° from the section shown in FIG. 28.

In FIGS. 28 and 29, the link spring 59 placed between the inner step 56*b* of the link joint 56 and the inner step 57*c* of the link 57 is not compressed, and the engaging portion 57*b* of the link 57 keeps a state engaged at the rear end of the slit 56*a* of the link joint 56.

That is, the link spring 59 is set in a sufficient strength for the spring 55 placed between the front side of the flange 53*d* of the slider 53 and the inner step at a front portion of the tip 52. The inner step 64*c* formed in the forward inner hole of the lead case 64 advances, but does not abut against the rear end of the chuck joint 62. At this time, since the lead 69 is gripped by the chuck 60, as the slider 53 advances, the leading end of the lead passes through the insertion hole of the stopper 54.

That is, the relation is L1=P−L2, where L1 is the projection length of the lead from the end member 53*a* described below (see FIG. 34).

Figure 30:
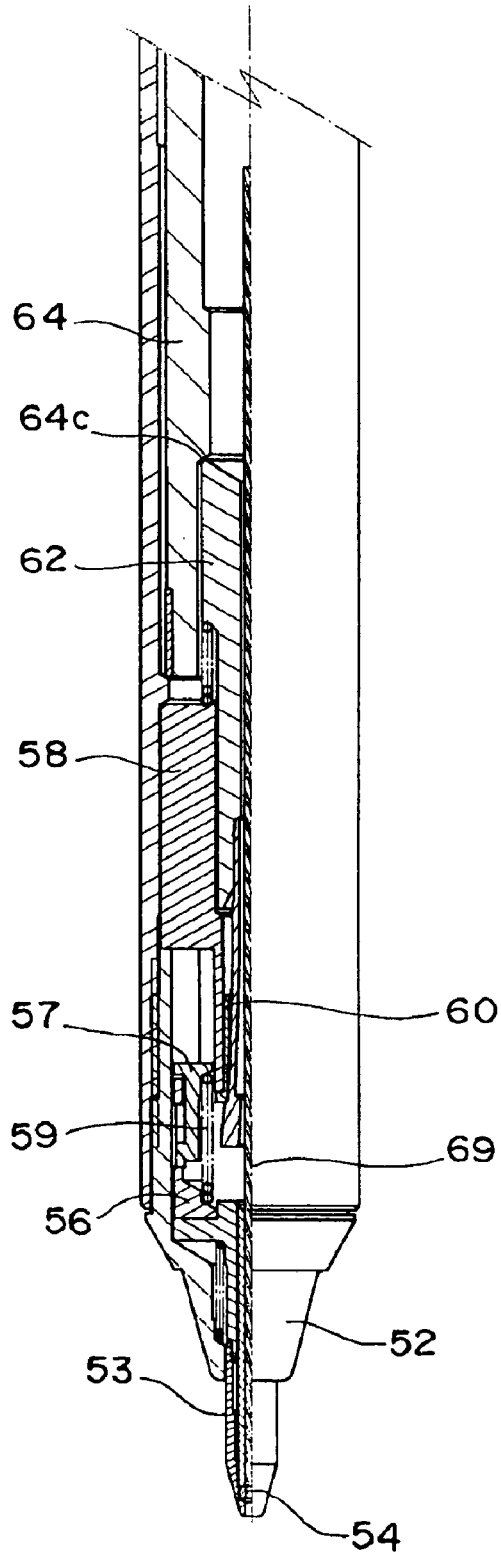
FIG. 30 is a sectional view showing a state of release of lead gripping by the chuck by advancing link and chuck joint by further advancing the lead case in blocked state of advance of slider.
Figure 31:
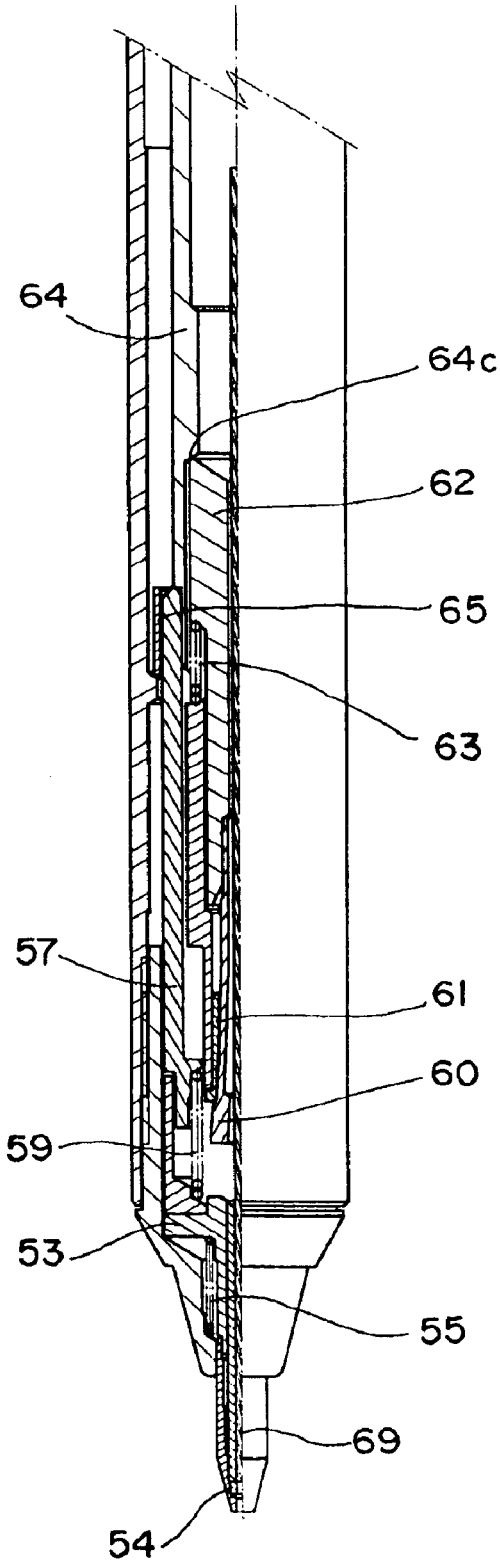
FIG. 31 is a sectional view corresponding to FIG. 30.

Further, as shown in FIGS. 30 and 31, while the forward move of the slider 53 is blocked, by knocking operation, when the lead case 64 advances further, the link 57 advances while compressing the link spring 59. FIG. 31 similarly shows a sectional view deviated by 90° from the section shown in FIG. 30.

The inner step 64*c* formed in the forward inner hole of the lead case 64 is also advanced, and abuts against the rear end of the chuck joint 62, and the chuck 60 is moved forward by way of the chuck joint 62, thereby releasing gripping of the lead 69.

When gripping of the lead 69 is released, the lead 69 falls by its own weight, and the leading end of the lead 69 abuts against the rear end of the stopper 54. The predetermined pressing force applied on the stopper 54 is at least the abutting force by the own weight of the lead applied on the stopper.

In this state, when knocking operation is cleared and the lead case 64 is moved back, while the slider 53 is held at the foremost position, the link 57 and chuck joint 622 move backward, and the lead 69 is gripped again. In this state, the engaging portion 57*b* of the link 57 is engaged at the rear end of the slit 56*a* of the link joint 56, and from this moment the link joint 56 is allowed to move backward. At the same time, by the restoring force of the spring 55, the slider 53 is ready to retreat.

Figure 32:
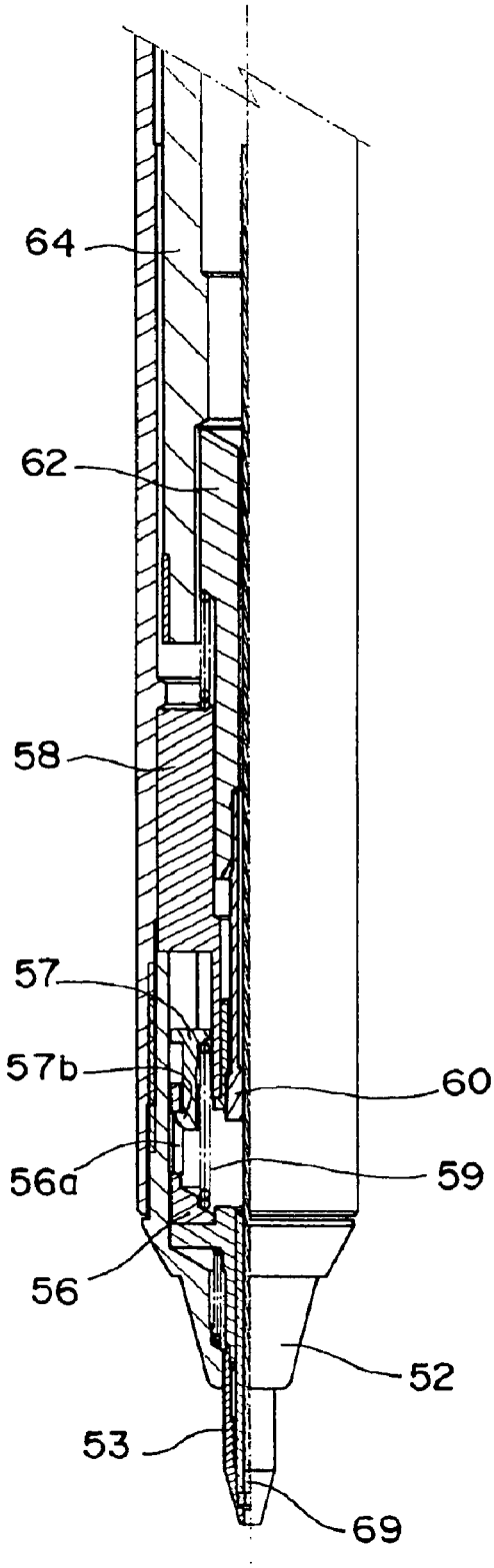
FIG. 32 is a sectional view showing a state of lead gripped again by the chuck by retreat of lead case and retreat of link and chuck joint with the slider held in the foremost position.
Figure 33:
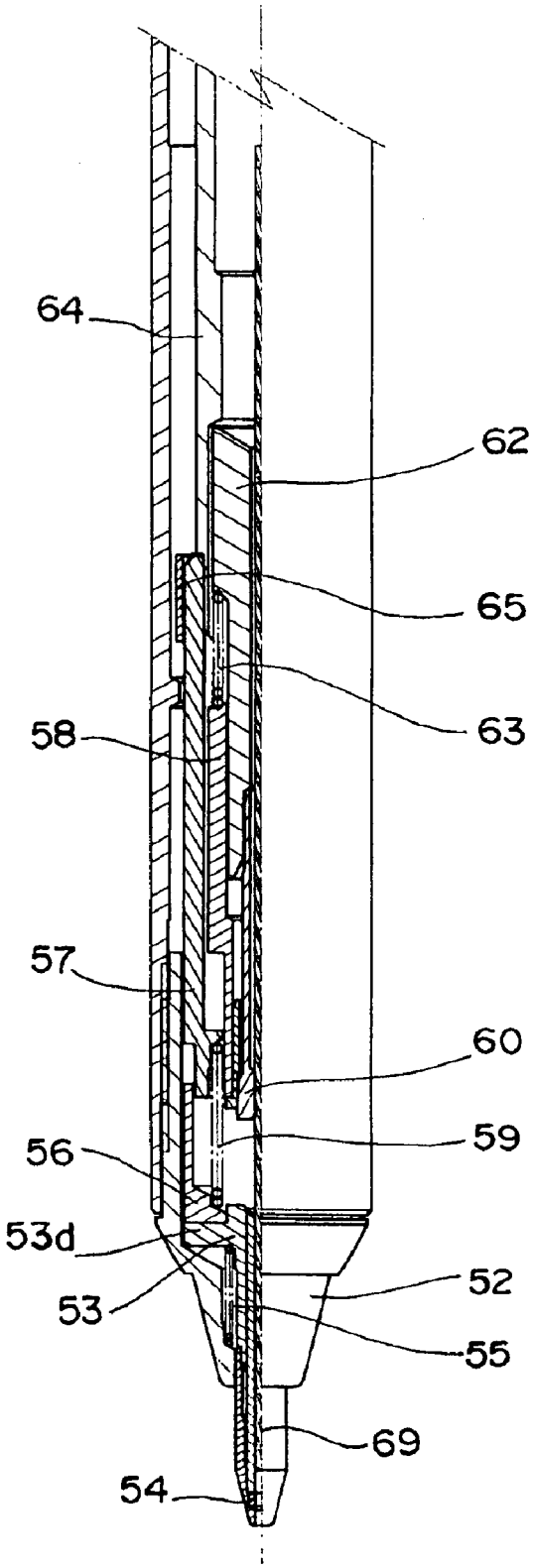
FIG. 33 is a sectional view corresponding to FIG. 32.

This state is shown in FIG. 32. FIG. 33 similarly shows a sectional view deviated by 90° from the section shown in FIG. 32.

Figure 34:
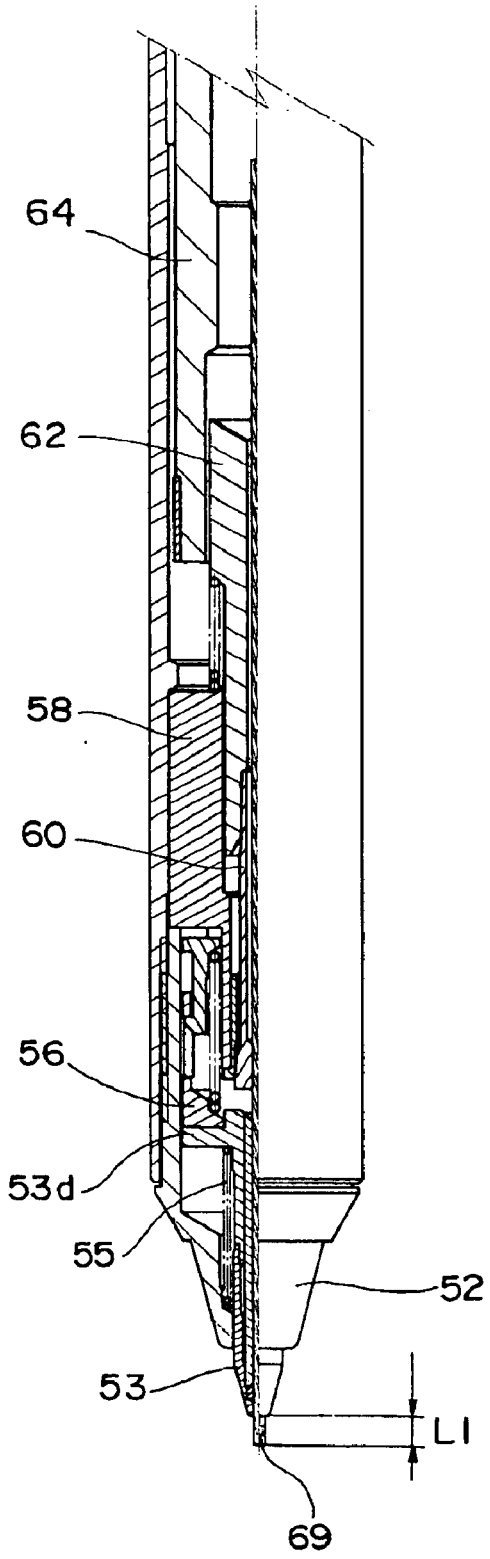
FIG. 34 shows a state of leading end of lead projected by a proper length from front end of tip member after retreat of lead case to initial state and the interval between front end of slider flange and the inner step behind the tip becomes P again.
Figure 35:
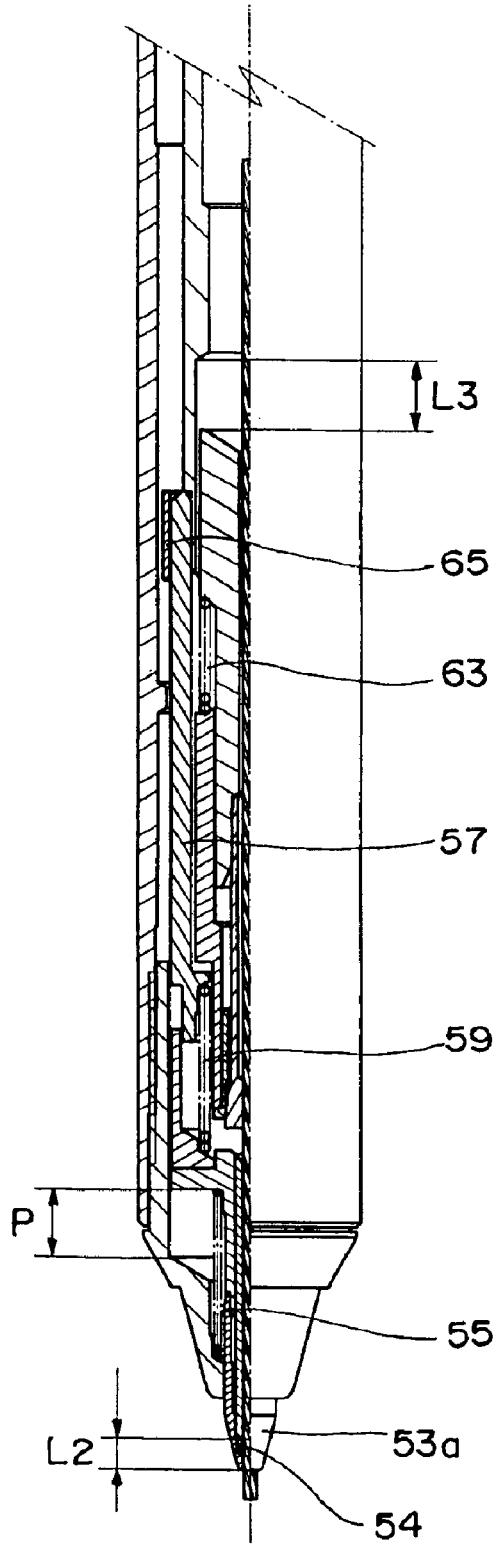
FIG. 35 is a sectional view corresponding to FIG. 34.
Figure 36:
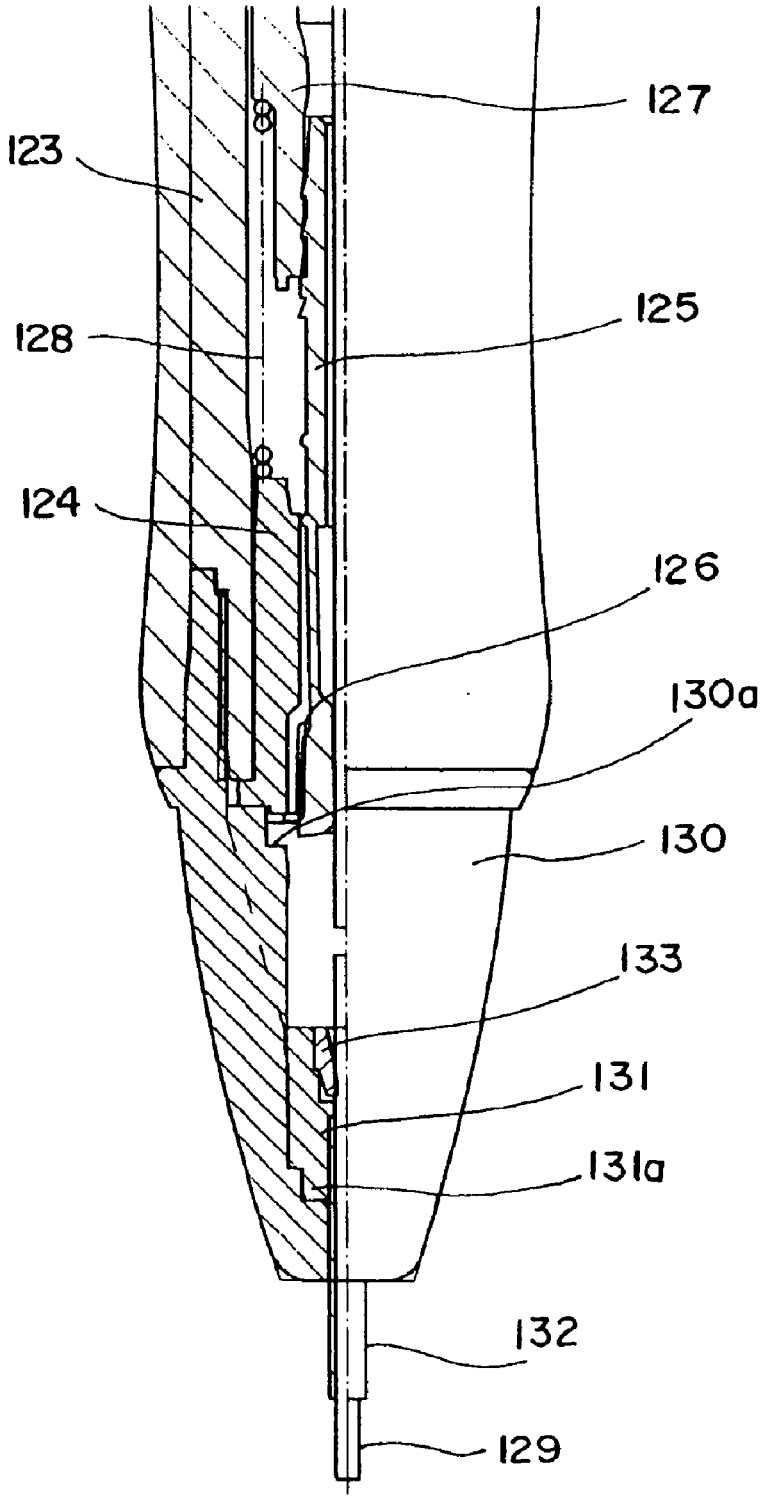
FIG. 36 is a sectional view of general lead propelling device in a conventional mechanical pencil.
Figure 37:
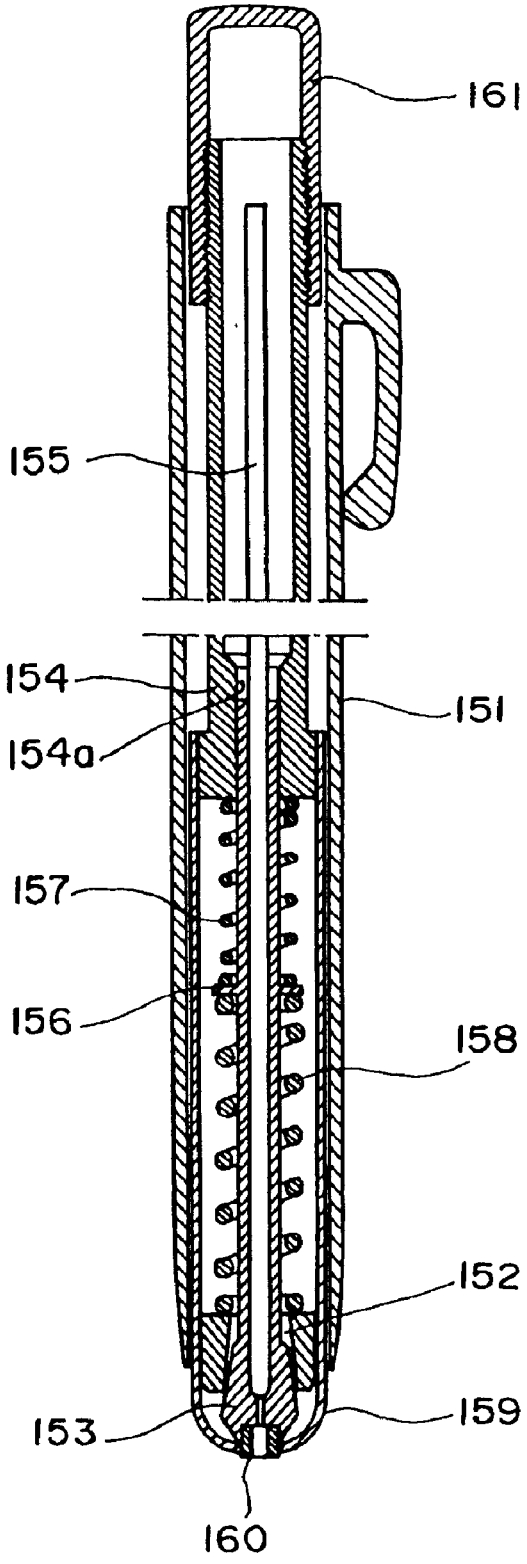
FIG. 37 is a sectional view of writing lead holder proposed in Japanese Utility Model Application Laid-open No. S55-99887.
Figure 38:
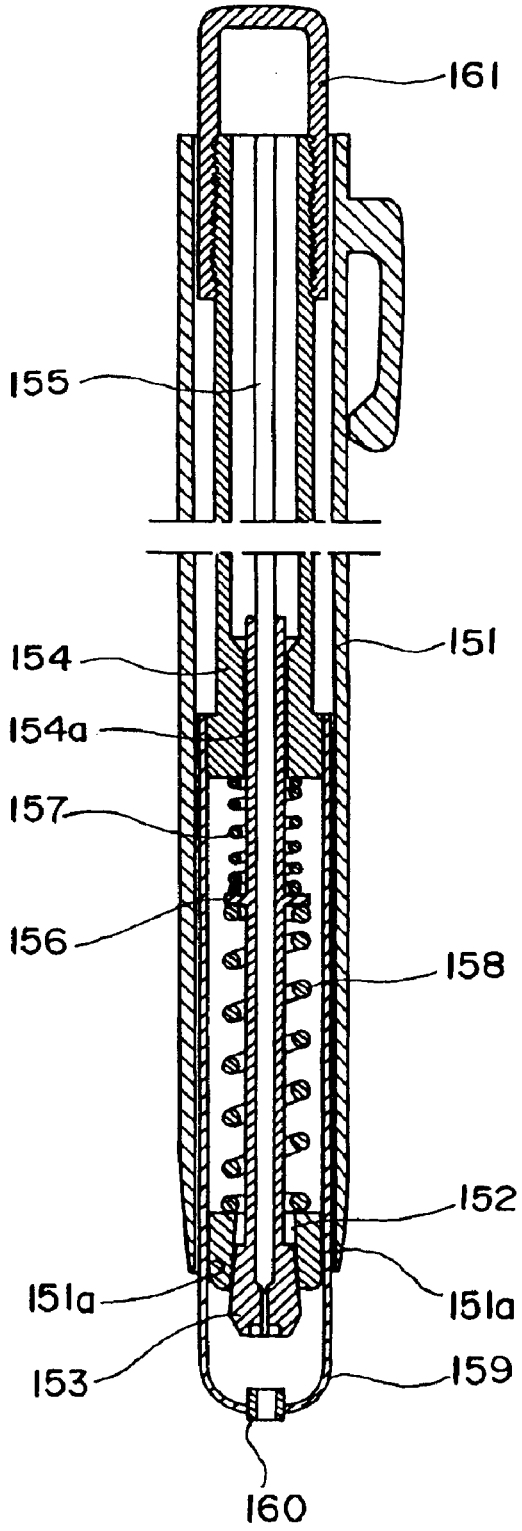
FIG. 38 is a sectional view showing working state of writing lead holder shown in FIG. 37.
Figure 39:
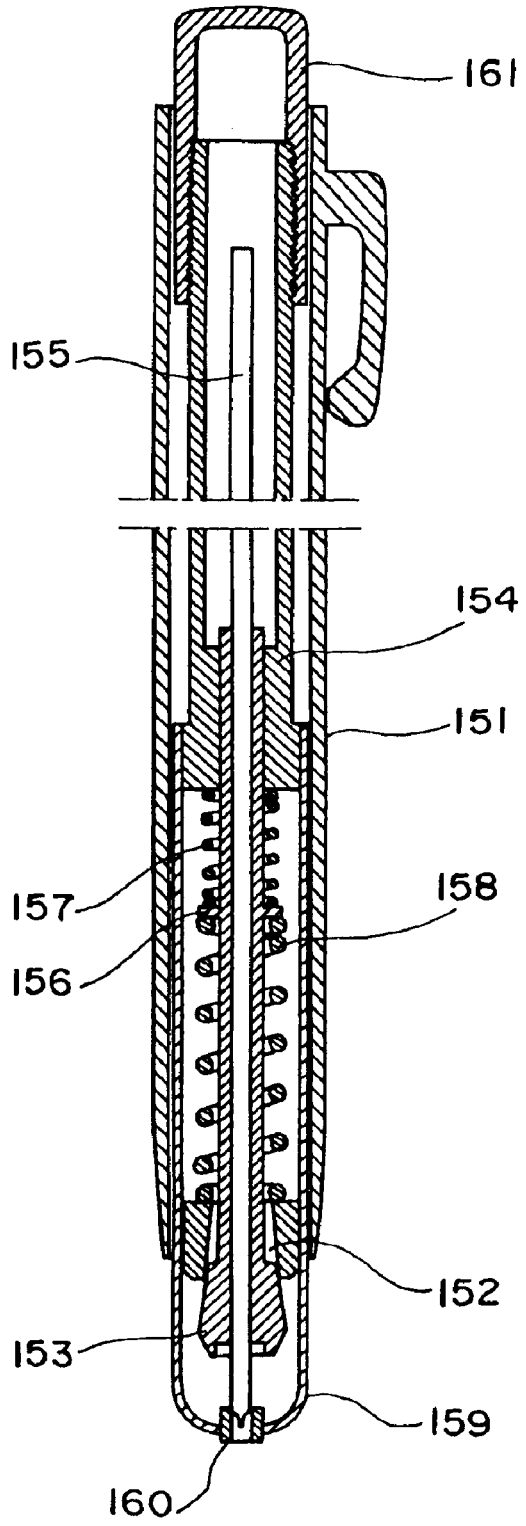
FIG. 39 is a sectional view showing working state of writing lead holder shown in FIG. 37.

As shown in FIGS. 34 and 35, when the lead case 64 retreats to the initial state, the interval of the front side of the flange 53*d* of the slider 53 and the inner step behind the tip 52 becomes P again. FIGS. 34 and 35 are sectional views deviated by 90° from each other.

At this time, since the biasing force of the spring 55 is set sufficiently stronger than the resistance of the lead 69 passing through the stopper 54, the leading end of the lead 69 passes through the stopper 54, and projects from the front end of the end member 53*a* by a proper length. The projection length L1 is defined as L1=P−L2 as mentioned above.

Incidentally, it is a demerit that the dimension of L3 may have a significantly large fluctuation in spite of a slight fluctuation of lead diameter. Therefore, in an extreme case, the dimension of L3 differs in every lead being sent into the chuck.

However, in the second embodiment, by setting at P<L3, the lead projection length L1 is defined by P−L2, and is indifferent to the above fluctuations.

In this state, if knocked again, the lead case 64 moves by distance L3, and the stopper 54 passes through at a front portion of the lead 69 as shown in FIGS. 28 and 29. After the state as shown in FIG. 30 (FIG. 31) and FIG. 32 (FIG. 33), the state as shown in FIG. 34 (FIG. 35) is established.

In this manner, even if the knocking operation is repeated, by repeating the operation as shown in FIGS. 28 to 35, the lead 69 is not projected more than a specified extent from the slider 53. If the lead 69 is worn out by writing, by this operation, the lead can be projected from the slider 53 only by the predetermined projection length.

As for the lead projection length L1, the optimum value differs depending on the lead diameter and lead hardness. Therefore, an adjusting mechanism is provided for adjusting the dimension of the interval P for obtaining an optimum lead projection length. As one of such means, by engagement of the crown 66 with the rear end outer periphery of the shaft tube 51, the crown 66 is rotated on the shaft tube 51, and the slider 53 is moved back and forth by way of the lead case 64 and link unit, so that the interval P is adjusted.

In the lead propelling device of the invention, as described herein, the lead is projected by a predetermined length from the leading end of the writing tool by knocking operation, and the lead is maintained at the predetermined length if the knocking operation is repeated, and hence it is free from problems such as breakage of lead or excessive projection of lead by knocking unknowingly while writing, and further the tip can be recognized visually and easily, it is easy to use, and if the lead is fine, the lead is not broken or damaged (so-called biting of lead or roughening of lead surface) by the gripping part of the chuck, so that outstanding effects may be obtained.

What is claimed is:

1. A lead propelling device comprising:

a lead gripping means for gripping and releasing the lead, said lead gripping means being switchable between a lead-gripping state and a lead-releasing state, said lead gripping means being movable between an advanced position and retracted position;

a stopper means for abutting against the lead to prevent the lead from advancing via gravity when said lead gripping means is in a lead releasing state, but allowing passage of the lead during a knock backward operation;

a knock operation means for receiving and transmitting a knocking force to said lead gripping means, said knock operation means being switchable between a neutral operation, a knock forward operation and a knock backward operation, said knock operation means transmitting a knocking force to said lead gripping means during a knock forward operation, which causes said lead gripping means to switch to a lead-releasing state and to move to an advanced position;

and said knock operation means not transmitting a knocking force to said lead gripping means during said knock backward operation, which allows said lead gripping means to return to a lead-gripping state and to return to its retracted position.

2. A lead propelling device for releasing lead by a lead gripping means by knock operation and gripping the lead by said lead gripping means when the knock operation is canceled, comprising:

a shaft tube having a leading end hole, a slider projecting from the leading end hole at the tip of the leading end of said shaft tube, said slider movable forward and backward and having an inner hole, a knock operation means connected to and movable with said slider, an elastically dislocatable stopper fixed in the inner hole of said slider for blocking insertion of the lead unless the lead is pushed by a minimum predetermined pressing force, the slider being biased backward by a spring so as to interlock with a lead case, said lead case having a step and said lead case being movable with said slider, a lead gripping means provided behind said slider, said lead gripping means having a rear part, said lead gripping means composed so as to grip or release the lead by departing or abutting between a step of said rear part of said lead gripping means and a step of said lead case, wherein said lead gripping means is adapted to grip the lead until said knock operation part is advanced by a predetermined distance, wherein when said knock operation means is further advanced from the predetermined distance, said slider and said lead gripping means advance in conjunction with said lead case, and said lead gripping means releases gripping of the lead, the lead may gravitationally fall against said stopper rear end, and when said knock operation means is subsequently moved backward by cancellation of the knock operation, said slider and said lead gripping means retreat, and when said lead gripping means grips the lead, only said slider moves backward to the initial position and the lead passes through said stopper, so that the lead is projected from the leading end of said slider by a predetermined length.

3. The lead propelling device of claim 1 or 2, wherein said lead gripping means comprises a cylindrical fixing tube having an inner hole, a tightening member fixed to the leading end of the inner hole provided in said fixing tube, a chuck for gripping and releasing the lead by said tightening member, a chuck joint fixed to the rear end of said chuck, and a chuck spring disposed between the rear end face of said fixing tube and said chuck joint for biasing said chuck backward.

4. The lead propelling device of claim 1 or 2, wherein said stopper has a hard part located at the abutting position of the leading end of the lead, and an elastic part is provided on the contour of said hard part so that the lead can pass through with a predetermined pressing force applied to the leading end of the lead.

5. The lead propelling device of claim 1 or 2, wherein said lead gripping means is fixed to a cylindrical shaft tube, a notch is provided at the side of said fixing tube or in an inner wall of said shaft tube so as to allow a space between said fixing tube and said shaft tube inner wall, a leg is provided at a front portion of said lead case so as to be movable forward and backward in the space, the front end of said leg and the rear end of said slider abut against each other so as to interlock, and a step is provided in said inner hole of said lead case as an operating part for expanding said lead gripping means, and said step abuts against said chuck joint as an operating part of said lead gripping means, thereby expanding said lead gripping means.

6. The lead propelling device of claim 2, wherein a leg is provided at a rear portion of said slider, the rear end face of the leg and the front end face of said lead case abut against each other so as to interlock, and a step is provided in said inner hole of said lead case as an operating part for expanding said lead gripping means, and said step abuts against the chuck joint as an operating part of said lead gripping means, thereby expanding said lead gripping means.

7. The lead propelling device of claim 2, wherein said slider and said lead case are coupled and fixed, and said lead case is biased backward by said spring.

8. The lead propelling device of claim 3, wherein said fixing tube is formed integrally with the shaft tube.

9. The lead propelling device of claim 3, wherein said tightening member is formed integrally with said fixing tube.

10. The lead propelling device of claim 2, wherein the predetermined length L1 of the lead projecting from said front end of said slider, the distance L2 from said slider front end to said stopper rear end, and the distance L3 between a step provided in the rear part of said lead gripping means and a step of said lead case in the state of gripping the lead by said lead gripping means are in the relation of L1=L3−L2.

11. The lead propelling device of claim 2, wherein the pressing, force P1 by which the lead can pass through said stopper and the initial tension P2 of the spring are set in the relation of P1<P2.

12. A lead propelling device for releasing the lead by a lead gripping means by knock operation and gripping the lead by said lead gripping means when the knock operation is canceled, comprising:

a shaft tube having a leading end hole, a slider projecting from said leading end hole at the tip of the leading end of said shaft tube, said slider movable forward and backward and having an inner hole, a knock operation means connected to and movable with said slider, an elastically dislocatable stopper fixed in the inner hole of said slider for blocking insertion of the lead unless the lead is pushed by a minimum predetermined pressing force, the slider being biased backward by a spring so as to interlock with a lead case by way of a link unit, a lead gripping means is provided on a rear portion of the slider in a state of gripping the lead, and said lead gripping means maintains the lead gripping state when knock operation is started, said slider advances in conjunction with said lead case by way of said link unit, the lead is departed from said stopper rear end by a predetermined distance when said slider advances to the maximum and the advance is blocked, and when the knock operation further continues said link unit contracts and said lead case advances, thereby releasing the lead by said lead gripping means, the lead abuts against the stopper rear end by spontaneous fall of the lead, and when knock operation is canceled, said lead gripping means grips the lead while said slider maintains the foremost position, and said slider retreats to the initial position, and the lead passes through said stopper, so that the lead is projected from the leading end of said slider by a predetermined length.

13. The lead propelling device of claim 12, wherein said stopper has a hard part located at the abutting position of the leading end of the lead, and an elastic part is provided on the contour of said hard part so that the lead can be passed through a predetermined pressing force applied to the leading end of the lead.

14. The lead propelling device of claim 12, wherein said lead gripping means has a structure of gripping and releasing the lead by abutment of a step in the rear part of said lead gripping means and a step of the lead case, and the timing of gripping or releasing the lead by said lead gripping means is determined by the spatial distance between the step in the rear part of said lead gripping means and the step of the lead case.

15. The lead propelling device of claim 12, wherein said link unit comprises a link joint, a link having its front end coupled at the rear portion of the link joint, and a link spring placed between an inner step of the link joint and an inner step of the link, and the link is always biased backward of the link joint by the link spring, the front end of said link joint abuts against the rear end of said slider, and said link is fixed to the forward part of said lead case, and said link unit interlocks with said lead case by knock operation to advance said slider, and the biasing force of said link spring is set so that said link may advance to said link joint from the state of blocking the advance at the foremost position of said slider.

16. The lead propelling device of claim 12, wherein said lead gripping means comprises a cylindrical fixing tube, a tightening member fixed to the leading end of an inner hole provided in the fixing tube, a chuck for gripping and releasing the lead by the tightening member, a chuck joint fixed to the rear end of the chuck, and a chuck spring disposed between the rear end face of the fixing tube and chuck joint for biasing the chuck backward, and said lead gripping means is fixed to a cylindrical shaft tube, a notch is provided at the side of said fixing tube or in the inner wall of said shaft tube so as to allow a space between said fixing tube and said shaft tube inner wall, said slider and said lead case interlock by means of a link unit through which a leg provided in the rear part of the link passes so as to be movable forward and backward in the space, and a step is provided in the inner hole of said lead case as an operating part for expanding said lead gripping means, and abuts against said chuck joint as an operating part of said lead gripping means, thereby expanding said lead gripping means.

17. The lead propelling device of claim 12, wherein the predetermined length L1 of the lead projecting from the front end of said slider, the distance L2 from said slider front end to said stopper rear end, and the distance P between the front end of flange of said slider and the inner step of the tip are in the relation of L1=P−L2.

18. The lead propelling device of claim 15, wherein the pressing force P1 by which the lead can pass through said stopper, the initial tension P2 of said spring, and the initial tension P3 of said link spring are set in the relation of P1<P2, P2<P3.

19. The lead propelling device of claim 16, wherein said fixing tube is formed integrally with said shaft tube.

20. The lead propelling device of claim 16, wherein said tightening member is formed integrally with said fixing tube.

* * * * *